US005089378A

United States Patent [19]

Ozaki et al.

[11] Patent Number: 5,089,378

[45] Date of Patent: * Feb. 18, 1992

[54] METHOD FOR FORMING AN IMAGE

[75] Inventors: Hiroyuki Ozaki; Ken Kawata; Hideki Ohmatsu, all of Kanagawa, Japan

[73] Assignee: Fuji Photo Film Co., Ltd., Kanagawa, Japan

[ * ] Notice: The portion of the term of this patent subsequent to Oct. 24, 2006 has been disclaimed.

[21] Appl. No.: 671,635

[22] Filed: Mar. 20, 1991

Related U.S. Application Data

[63] Continuation of Ser. No. 290,223, Dec. 27, 1988, abandoned, Continuation-in-part of Ser. No. 917,642, Oct. 10, 1986, abandoned.

[30] Foreign Application Priority Data

Oct. 14, 1985 [JP] Japan ..... 60-228267

[51] Int. Cl.[5] ..... G03C 1/00; G03C 5/26

[52] U.S. Cl. ..... 430/351; 430/353; 430/354; 430/355; 430/617; 430/619; 430/620

[58] Field of Search ..... 430/203, 351, 353, 354, 430/355, 617, 619, 620

[56] References Cited

U.S. PATENT DOCUMENTS 4,499,172 2/1985 Hirai et al. ..... 430/619
4,626,500 12/1986 Sato et al. ..... 430/619
4,629,684 12/1986 Sato et al. ..... 430/619
4,704,345 11/1987 Hirai et al. ..... 430/203
4,732,846 3/1988 Aono et al. ..... 430/619
4,788,134 11/1988 Ozaki et al. ..... 430/203

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A method for forming an image comprising heating a heat-developable light-sensitive material comprising a support having thereon at least a light-sensitive silver halide and a binder, simultaneously with or after image-wise exposure thereof in the presence of water, at least one of a base and a base precursor, and an acetylene compound represented by formula (I):

$$R_1—C{\equiv}C—R_2 \quad (I)$$

wherein $R_1$ and $R_2$ each represents a hydrogen atom, a carboxyl group, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted alkoxycarbonyl group, a substituted or unsubstituted aryl group, a substituted or unsubstituted heterocyclic group, or a substituted or unsubstituted carbamoyl group; provided that both $R_1$ and $R_2$ do not represent hydrogen atoms at the same time.

14 Claims, No Drawings

METHOD FOR FORMING AN IMAGE

This is a continuation of application Ser. No. 07/290,223 filed Dec. 27, 1988, which is a continuation-in-part of application Ser. No. 06/917,642 filed Oct. 10, 1986, now abandoned.

FIELD OF THE INVENTION

The present invention relates to a heat-developable photographic element and, in particular, to a heat-developable photographic element which has stable photographic properties even if development processing conditions fluctuate.

BACKGROUND OF THE INVENTION

Since photography using a silver halide has excellent photographic characteristics such as sensitivity and gradation control as compared with other types of photography such as electrophotography and a diazo process, it has been used most widely so far. In recent years, a technology enabling the simple and rapid obtainment of an image has been developed by changing a processing method for forming an image of light-sensitive material using a silver halide from the conventional wet processing with a developing solution and the like near the normal temperature to a heat development processing using no developing solution.

A heat-developable light-sensitive material is known in the photographic technical field. The heat-developable light-sensitive material and its process are mentioned, for example, in *Shashinkogaku no Kiso* (*Basis of Photographic Engineering*) (published by Corona Co., 1979), pp. 553 to 555; in *Eizo Joho* (*Image Information*) (published in April, 1978), p. 40; in *Neblette's Handbook of Photography and Reprography*, 7th Ed., Van Nostrand Reinhold Company, pp. 32 and 33; in U.S. Pat. Nos. 3,152,904, 3,301,678, 3,392,020 and 3,457,075, in British Patents 1,131,108 and 1,167,777; and in *Research Disclosure*, RD No. 17029 (June, 1978), pp. 9 to 15.

Many methods have been proposed for obtaining a color image by heat development. Relating to a method for forming a color image by coupling of an oxidant of the developing agent with a coupler, there have been proposed a reducing agent of p-phenylenediamines and a phenolic or active methylene coupler in U.S. Pat. No. 3,531,286, a p-aminophenol type reducing agent in U.S. Pat. No. 3,761,270, a sulfonamido phenol type reducing agent in Belgian Patent 802,519 and in *Research Disclosure* (Sept. 31, 1975), pp. 31 and 32, and a combination of a sulfonamido phenol type reducing agent with a 4-equivalent coupler in U.S. Pat. No. 4,021,240.

A method for forming a positive color image by a light-sensitive silver dye bleaching process is mentioned, for example, in *Research Disclosure*, RD No. 14433 (April, 1976), pp. 30 to 32, in *Research Disclosure*, RD No. 15227 (December, 1976), pp. 14 and 15, and in U.S. Pat. No. 4,235,957.

Further, a method for forming an image by heat development which utilizes a compound having a dye part and able to release a mobile dye corresponding or counter-corresponding to a reduction reaction of silver halide to silver at an elevated temperature is disclosed in European Patent Application Nos. 76,492A and 79,056A, and in Japanese Patent Application (OPI) Nos. 28928/83 and 26008/83 (the term "OPI" as used herein refers to a "published unexamined Japanese patent application").

Such a heat-developable light-sensitive material is developed by applying heat, but there often arise problems that the development progresses too far and fog increases because the light-sensitive material once heated requires too much time for its temperature fall and, in the case where a dye formed or released in a light-sensitive element is transferred to an image receiving element, excessive development is caused by heating for the transfer, and the transferred image has increased fog. Further, it is difficult to heat a light-sensitive material to a high temperature uniformly and unevenness of heating temperatures is formed. Even if a light-sensitive material is heated uniformly, an unevenness of the amount of image formation accelerators such as water, a base, and the like existent in the light-sensitive material is formed. Therefore, the heat-developable light-sensitive material presents problems that the development and the transfer of dye progress unevenly for the above-mentioned causes, thereby forming an image lacking in uniformity and lowering the image quality.

SUMMARY OF THE INVENTION

An object of the present invention is to provide a heat-developable light-sensitive material able to prevent an increase in fog caused by overdevelopment and able to prevent unevenness in image density caused by unevenness of heated temperatures.

The above and other objects of the present invention have been attained by a method for forming an image comprising heating a heat-developable light-sensitive material comprising a support having thereon at least a light-sensitive silver halide and a binder, simultaneously with or after imagewise exposure thereof in the presence of water, at least one of a base and a base precursor (referred to as "a base and/or a base precursor" hereinafter), and an acetylene compound represented by formula (I):

$$R_1—C{\equiv}C—R_2 \qquad (I)$$

wherein $R_1$ and $R_2$, which may be the same or different, each represents a hydrogen atom, a carboxyl group, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted alkoxycarbonyl group, a substituted or unsubstituted aryl group, a substituted or unsubstituted heterocyclic group, or a substituted or unsubstituted carbamoyl group; provided that both $R_1$ and $R_2$ do not represent hydrogen atoms at the same time.

DETAILED DESCRIPTION OF THE INVENTION $R_1$ and $R_2$ will be described in detail hereinafter.

The alkyl group represented by $R_1$ and $R_2$ may be linear or branched. Examples of the alkyl group include a butyl group, an isobutyl group, a hexyl group, a heptyl group, an octyl group, a dodecyl group, a pentadecyl group, and the like. Examples of the substituent of the substituted alkyl group include an alkoxy group (such as a methoxy group), a hydroxyl group, a cyano group, a halogen atom, a sulfonamido group, a carboxyl group or its salt, a sulfonic group or its salt, a substituted or unsubstituted amino group, an alkynyl group (such as an ethynyl group) and the like.

Examples of the cycloalkyl group include a cyclopentyl group, a cyclohexyl group, a decahydronaphthyl group and the like. Examples of the alkenyl group include a propenyl group, an isopropenyl group, a styryl group and the like. Examples of the alkynyl group include an ethynyl group, a phenylethynyl group and the like. Examples of the alkoxycarbonyl group include a methoxycarbonyl group, an ethoxycarbonyl group and the like. These groups may have the same substituent groups as described above for the substituted alkyl group.

Examples of the aryl group include a phenyl group, a naphthyl group and the like. Examples of the substituent of the substituted aryl group include an alkyl group (such as a methyl group and a dodecyl group), a hydroxyl group, a cyano group, a nitro group, an amino group, an acylamino group, a sulfonamido group (including one containing an aliphatic, aromatic or heterocyclic group), an alkoxy group, an aryloxy group, an alkoxycarbonyl group, a ureido group, a carbamoyl group, an acyloxy group, a heterocyclic group (a 5- or 6-membered heterocyclic group is preferred, and a nitrogen-containing one is more preferred), an alkylsulfonyl group, a carboxyl group or its salt, a sulfonic group or its salt, a sulfamoyl group, a halogen atom (a fluorine, bromine, chlorine, or iodine atom), a substituted or unsubstituted alkynyl group (such as an ethynyl group) and the like. These substituents may have a further substituent. Further, the substituted aryl group may have two or more substituents of the above-mentioned groups.

Examples of the aralkyl group include a benzyl group, a diphenylhydroxymethyl group, a phenylhydroxymethyl group and the like. The aralkyl group may have the same substituent as in the above-mentioned aryl group.

As the heterocyclic group, a 5- or 6-membered heterocyclic ring is preferred and examples thereof include a furyl group, a thienyl group, a benzothienyl group, a pyridyl group, a quinolyl group and the like. The heterocyclic group may have the same substituents as in the above-mentioned substituted aryl group.

Examples of the carbamoyl group include —$CONH_2$, a carbamoyl group having a substituted or unsubstituted alkyl, aryl or heterocyclic group as mentioned above.

Of the above-mentioned compounds represented by formula (I), a compound in which one of $R_1$ and $R_2$ is a hydrogen atom and the other is a group other than a hydrogen atom is preferred, and a compound in which one of $R_1$ and $R_2$ is a hydrogen atom and the other is a substituted or unsubstituted phenyl group is more preferred.

Specific examples of the acetylene compound of the present invention will be shown hereinafter.

$CH_3OOC-C\equiv C-COOCH_3$ (1)

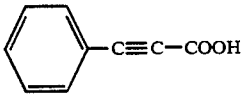
(2)

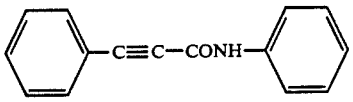
(3)

-continued

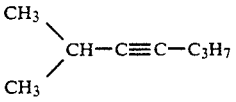
(4)

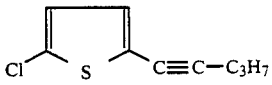
(5)

$H_2NOC-C\equiv CH$ (6)

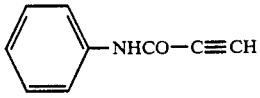
(7)

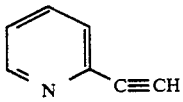
(8)

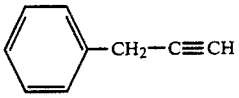
(9)

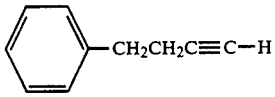
(10)

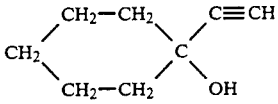
(11)

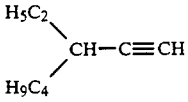
(12)

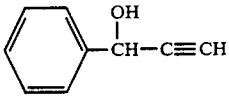
(13)

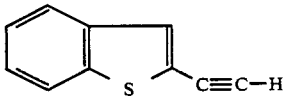
(14)

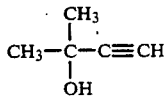
(15)

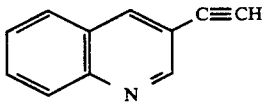
(16)

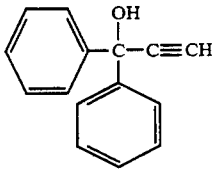
(17)

-continued

(18) $H_{31}C_{15}-C\equiv C-H$

(19) $CH_3O-CH_2CH_2-OCH_2C\equiv C-H$

(20) $C(CH_2OCH_2C\equiv CH)_3$
$CH_2OCH_2C\equiv CH$ (21)

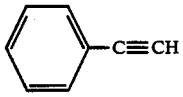

(22)

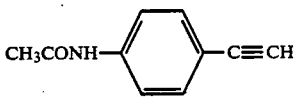

(23)

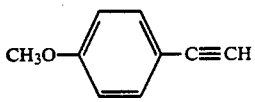

(24)

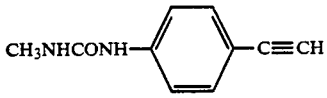

(25)

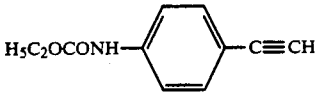

(26)

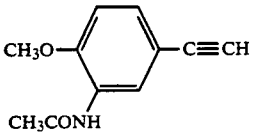

(27)

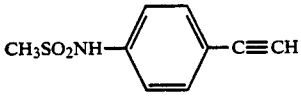

(28)

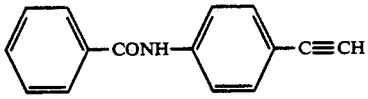

(29)

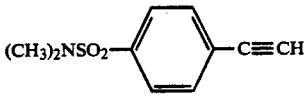

(30)

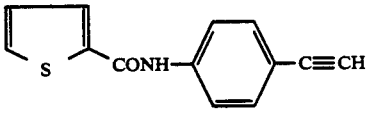

(31)

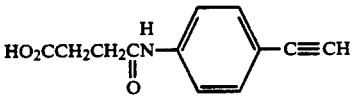

-continued (32)

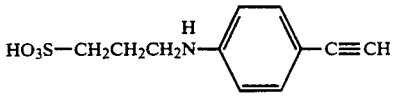

(33) $HO-CH_2\leftarrow CH_2\rightarrow_7 CH_2C\equiv CH$

(34) $HO_3S-CH_2CH_2CH_2-C\equiv CH$

(35) $HO_2C-CH_2CH_2CH_2-C\equiv CH$ (36)

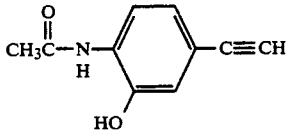

(37)

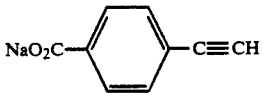

(38)

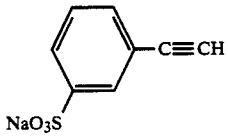

(39)

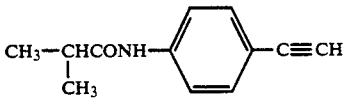

(40)

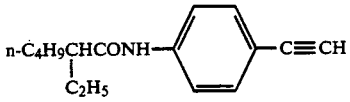

The light-sensitive material of the present invention comprises a light-sensitive element and, if required, a dye fixing element.

The acetylene compound according to the present invention can be dissolved in a water-soluble organic solvent (such as methanol, ethanol, acetone, dimethylformamide, or the like) or in a mixture of these organic solvents with water and then can be contained in a binder of a light-sensitive element and/or in a binder of a dye fixing element.

If the light-sensitive element and the dye fixing element have a multilayer construction described hereinafter, the acetylene compound can be contained in an arbitrary layer.

The preferred amount of the acetylene compound in the dye fixing element is from $10^{-6}$ to $10^{-2}$ mol/m$^2$, more preferably from $10^{-5}$ to $10^{-3}$ mol/m$^2$.

If the acetylene compound is contained in the light-sensitive element, the preferred amount of the acetylene compound is from $10^{-4}$ to 1 mol per mol of silver, more preferably from $10^{-3}$ to $5\times10^{-1}$ mol per mol of silver.

The acetylene compound according to the present invention may be dissolved in a water-soluble organic solvent and may be contained in water. The content of the compound in the water is from $10^{-4}$ to 1 mol/l, more preferably from $10^{-3}$ to $10^{-1}$ mol/l.

The base and/or base precursor for use in the present invention can be used in an amount of extensive range.

If the base and/or base precursor are used in the light-sensitive layer and/or the dye fixing layer which layer is used when occasion demands, it is preferable to use the base and/or base precursor in each layer in an amount of 50 wt % or less based on the coated weight of each coated layer and it is more preferred to use in an amount of from 0.01 to 40 wt % based on the coated weight of each coated layer. When the base and/or base precursor are used in a form contained in water, the preferred concentration of the base and/or base precursor is from 0.005 to 2 mol/l, more preferably from 0.05 to 1 mol/l.

Examples of the base of the present invention include inorganic bases such as hydroxide, carbonate, bicarbonate, borate, secondary phosphate, tertiary phosphate, quinolinate, or metaborate of an alkali metal, alkaline earth metal, or quaternary alkyl ammonium and the like; organic bases such as aliphatic amines, aromatic amines, heterocyclic amines, amidines, cyclic amidines, guanidines, cyclic guanidines, and the like; and the carbonate, bicarbonate, borate, secondary phosphate, and tertiary phosphate of these organic bases.

As the base precursor of the present invention, precursors of the above-mentioned organic bases can be used. The base precursor used herein is a compound releasing or generating a base when thermally decomposed or electrolyzed. Examples thereof include a salt of a thermally decomposable organic acid such as trichloroacetic acid, cyanoacetic acid, acetoacetic acid, $\alpha$-sulfonyl acetic acid, and the like, with the above-mentioned organic bases, and a salt of the thermally decomposable organic acid with 2-carboxycarboxamide as mentioned in U.S. Pat. No. 4,088,496. Besides these, base precursors as mentioned in British Patent 998,945, U.S. Pat. No. 3,220,846, and Japanese Patent Application (OPI) No. 22625/75 can be used.

Examples of the compound releasing or generating a base when electrolyzed include various fatty acid salts as a representative method using electrolytic oxidation. By this reaction, the carbonate of an alkali metal or an organic base such as guanidines and amidines can be obtained very efficiently. Examples of the method using electrolytic reduction include a method for producing amines by reduction of a nitro compound and of a nitroso compound, a method for producing amines by reduction of nitriles, and a method for producing p-aminophenols, p-phenylenediamines, hydrazines, etc., by reduction of a nitro compound, an azo compound, an azoxy compound, etc. p-Aminophenols, p-phenylenediamines, and hydrazines can be used not only as a base but also as a color image forming substance directly. Further, a method for forming an alkali component by electrolysis of water in the presence of various inorganic salts can be utilized.

Preferred specific examples of the base and base precursor include lithium hydroxide, sodium hydroxide, barium hydroxide, sodium carbonate, cesium carbonate, sodium hydrogencarbonate, potassium carbonate, potassium hydrogencarbonate, sodium quinolinate, sodium secondary phosphate, potassium secondary phosphate, sodium tertiary phosphate, potassium tertiary phosphate, potassium pyrophosphate, sodium metaborate, borax, ammonia water, tetramethyl ammonium hydroxide, tetraethyl ammonium hydroxide, $(CH_3)_2NH$, $(C_2H_5)_2NH$, $C_3H_7NH_2$, $HOC_2H_4NH_2$, $(HOC_2H_4)_2NH$, $(HOC_2H_4)_3N$, $H_2NC_2H_4NH_2$, $H_2NC_4H_8NH_2$, $CH_3NHC_2H_4NHCH_3$, $(CH_3)_2NC_3H_6N(CH_3)_2$,

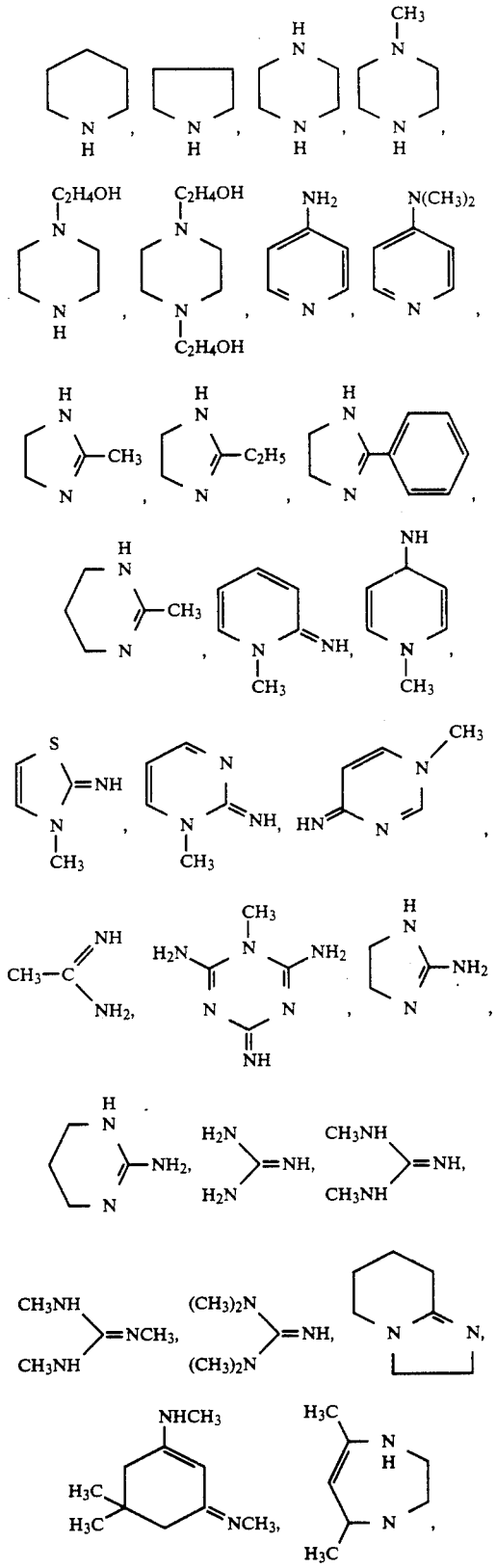

guanidine trichloroacetic acid, piperidine trichloroacetic acid, morpholine trichloroacetic acid, p-toluidine trichloroacetic acid, 2-picoline trichloroacetic acid, guanidine carbonate, piperidine carbonate, morpholine carbonate, tetramethyl ammonium trichloroacetic acid salt, and the like.

The base precursor other than the above include a combination of a water-slightly-soluble metallic compound with a compound capable of reacting with ions of the metal constituting the water-slightly-soluble metallic compound to form a complex. By mixing the above-mentioned two compounds, a base can be formed. As the water-slightly-soluble metallic compound, a hydroxide, an oxide, a carbonate, etc., of zinc, aluminum, barium, calcium, etc., can be used. The complex forming compound is described in detail, for example, in *Critical Stability Constants* (written by A. E. Martell and R. E. Smith, Vol. 1-5, Plenum Press).

Specific examples of the complex forming compound include amino carboxylic acids, imino diacetic acid and its derivatives, aniline carboxylic acids, pyridine carboxylic acids, aminophosphoric acids, carboxylic acids (including mono-, di-, tri-, and tetracarboxylic acids and those having a substituent such as a phosphono, hydroxy, oxo, ester, amide, alkoxy, mercapto, alkylthio, and phosphino group, or the like), hydroxamic acids, polyacrylates, alkali metal salts of polyphosphoric acids, guanidines, amidines, and quaternary ammonium salts.

It is advantageous that the water-slightly-soluble metallic compound and the complex forming compound are separately added into the light-sensitive and dye fixing element.

The base and/or base precursor can be used singly or in combination of two or more compounds.

The water used in the present invention is not limited to so-called pure water but includes water generally used in this field of art. The water also includes a mixture of water with a low boiling solvent such as methanol, DMF, acetone, or diisobutyl ketone, and an aqueous solution containing a dye release assistant, an accelerator and a hydrophilic heat solvent to be described later.

The amount of water used in the present invention is at least one tenth of the total weight of the whole coated layers of the light-sensitive element and a dye fixing element which is used optionally. The preferred amount of water is from one tenth of the total weight of the whole coated layers to the weight of water corresponding to the maximum swelling volume of the whole coated layers, and the more preferred amount of water is from one tenth of the weight of the whole coated layers to the value after substracting the weight of the whole coated layers from the weight of water corresponding to the maximum swelling volume of the whole coated layers.

The state of the coated layer when swollen is unstable and localized stains may be formed. To avoid this, it is preferred that the amount of water be less than the weight of water corresponding to the maximum volume of the whole coated layers swollen of the light-sensitive element and the dye fixing element.

However, even if the amount of water exceeds the above-mentioned weight, only the above-mentioned defect is caused and the effects of the present invention are not damaged and the same effects as in the amount of water of the preferred range are obtained.

The maximum swelling volume of the coated layer is determined by dipping the coated layer of the light-sensitive element or the dye fixing element in water to swell it sufficiently, after that, determining the thickness of the layer by measuring the cross section of the coated layer swollen with a microscope or the like, and then multiplying the layer thickness by the area of the coated layer of the light-sensitive element or the dye fixing element.

A method for measuring a degree of swelling is mentioned in *Photographic Science and Engineering,* Vol. 16, p. 449 (published in 1972).

A degree of swelling of a gelatin layer varies markedly with the degree of hardening but it is usually controlled to the degree of hardening so that the thickness of the gelatin layer when swollen at maximum becomes 2 to 6 times the thickness of the dry gelatin layer.

In the present invention, water is supplied to the light-sensitive element but it may be supplied to the dye fixing element used optionally to allow it to transfer from the dye fixing element to the light-sensitive element. Further, water may be supplied to both the light-sensitive element and the dye fixing element.

A method for supplying water in the process of the present invention is not limitative. For example, water may be injected as a jet through a small hole, it may be supplied with a web roller, or it may be supplied in such a manner as to squeeze a pod having water within it.

Because heating is utilized in the process of the present invention, development in the process of the present invention can be carried out at a pH value much lower than that when developed in a so-called color diffusion transfer process in which a developing solution is spread in a film unit and the development is carried out near a normal temperature. When the pH value is high, fog is markedly increased thus disadvantageous. Therefore, it is preferred that the pH value of the layers when heated for development and dye transfer is 12 or less, more preferably from 11 to 7.0.

In the present invention, at the same time or after the heat-developable light-sensitive material is exposed to light, the light-sensitive material is heated to be developed, and the light-sensitive material contains a relatively large amount of water as a solvent. Therefore, the maximum temperature of the light-sensitive material depends upon the boiling point of an aqueous solution (containing various additives in the water) in the light-sensitive material. It is preferred that the minimum temperature is 50° C. or higher. As the boiling point of water is 100° C. at normal pressure and the content of water of the light-sensitive material often lowers due to evaporation of water if the material is heated to 100° C. or higher, it is preferred to cover the surface of the light-sensitive material with a material impermeable to water or to supply high temperature and high pressure steam to the light-sensitive material. In the latter process, the boiling point of the aqueous solution rises, so that the temperature of the light-sensitive material can also rise advantageously.

The heating means for the light-sensitive material may be a simple heating plate, an iron, a heating roller, a heating plate using carbon or titanium white, or similar means.

The silver halide usable in the light-sensitive material of the present invention may be any of silver chloride, silver bromide, silver chlorobromide, silver iodobromide, and silver chloroiodobromide. The halogen composition within the silver halide particles may be uniform or the halogen composition may assume a multistructure (core/shell structure) in which the halogen composition differs between the surface and the interior of the particles as mentioned in Japanese Patent Application (OPI) Nos. 154232/82, 108533/83 and 48755/84, U.S. Pat. No. 4,433,048 and European Patent 100,984.

In the preparation of an emulsion having core/shell structure, after a core particle is formed first, a shell part may be formed without processing the core particle, or the core particle is washed with water and desalted, and after that the shell part may be formed. A process for forming a core particle and forming a shell part thereon is mentioned in detail in Japanese Patent Application (OPI) No. 143331/85.

The particle shape of the silver halide for use in the present invention is not limitative, and silver halide having any particle shapes such as a cube, an octahedron, a tetradecahedron, a sphere, a disc, a potato type, an irregular polyhedron, and a tabular type (a tabular particle having a thickness of 0.5 μm or less, a diameter of at least 0.6 μm and an average aspect ratio of 5 or more described, e.g., in U.S. Pat. Nos. 4,414,310 and 4,435,499 and West German Patent Application (OLS) No. 3,241,646 A1) can be used.

An epitaxial junction type silver halide particle described in Japanese Patent Application (OPI) No. 16124/81 and U.S. Pat. No. 4,094,684 can also be used.

In the present invention, both a monodispersed emulsion (mentioned in Japanese Patent Application (OPI) Nos. 178235/82, 100846/83 and 14829/83, International Patent Application No. 83/02338A1, and European Patent Application Nos. 64,412A3 and 83,377A1) and a poly-dispersed emulsion can be used.

Two or more kinds of silver halides which are different in particle shape, halogen composition, particle size and particle size distribution can be combined for use. Two or more kinds of monodispersed emulsions different from each other in particle size can be mixed to control the gradation.

The preferred average particle size of the silver halide used in the present invention is from 0.1 to 10 μm; more preferably from 0.1 to 4 μm.

A photographic emulsion used in the present invention can be prepared by methods as mentioned in *Chimie et Physique Photographique,* written by P. Glafkides (Paul Montel, 1967), *Photographic Emulsion Chemistry,* written by G. F. Duffin (The Focal Press, 1966), *Making and Coating Photographic Emulsion,* written by V. L. Zelikman et al. (The Focal Press, 1964), and the like. The emulsion can be prepared by any of an acid process, a neutral process and an ammonia process. As a form for reacting a soluble silver salt with a soluble halogen salt, any of a single jet method, a double jet method, and a combination of these methods may be used.

A method for forming silver halide in the presence of excessive silver ions (that is, a so-called reverse jet method) can also be used. As one form of the double jet method, a method for forming silver halide while maintaining the pAg constant in a liquid phase, that is, a so-called controlled double jet method, can also be used.

Further, to increase particle growth speed, the concentration, amount, or addition speed of the silver salt and the halogen salt solutions may be increased (Japanese Patent Application (OPI) Nos. 142329/80 and 158124/80 and U.S. Pat. No. 3,650,757).

While or after silver halide particles are formed, the surface of silver halide grains may be substituted by a halogen which forms hardly soluble silver halide particles.

Further, as the method for stirring a reaction solution, any known method may be used. The temperature and pH value of the reaction solution while silver halide particles are formed are not limited.

In the stage for forming silver halide particles used in the present invention, ammonia, a derivative of organic thioether as mentioned in Japaneae Patent Publication No. 11386/72, or a sulfur compound as mentioned in Japanese Patent Application (OPI) No. 144319/78 can be used as a silver halide solvent.

In the process of particle formation or of physical ripening, a cadmium salt, a zinc salt, a lead salt, a thallium salt, or the like may be allowed to coexist.

Further, with the aim of improving the high intensity reciprocity and low intensity reciprocity of the light-sensitive material, a water-soluble iridium salt such as iridium chloride (III, IV) or ammonium hexachloroiridate or a water-soluble rhodium salt such as rhodium chloride can be used.

In the process for formation of silver halide particles of the present invention, a nitrogen-containing compound as mentioned in Japanese Patent Publication No. 7781/71, Japanese Patent Application (OPI) Nos. 222842/85 and 122935/85 may be added.

Soluble salts in a photographic emulsion are usually removed from the emulsion after the precipitation of silver halide is formed or ripened physically, and as a means for the removal, a noodle water washing method having been known where the gelatin is gelled may be used, or a sedimentation (flocculation) method using inorganic salts containing polyvalent anions, for example, sodium sulfate, an anionic surface active agent, an anionic polymer (e.g., polystyrene sulfonic acid), or a gelatin derivative (e.g., aliphatic acylated gelatin, aromatic acylated gelatin, aromatic carbamoylated gelatin, or the like) may be used. The process for removing soluble salts may be omitted.

It is advantageous to use gelatin as a protective colloid and other hydrophilic binders when the emulsion of the present invention is prepared, but hydrophilic colloids other than gelatin can also be used. For example, proteins such as gelatin derivatives, graft polymers of gelatin with other high molecular weight substances, albumin, casein, and the like; cellulose derivatives such as hydroxyethyl cellulose, carboxymethyl cellulose, cellulose sulfate, and the like; sugar derivatives such as sodium alginate, starch derivatives, and the like; and various synthetic hydrophilic high molecular weight substances such as polyvinyl alcohol, partial acetals of polyvinyl alcohol, poly-N-vinylpyrrolidone, polyacrylic acid, polymethacrylic acid, polyacrylamide, polyvinyl imidazole, polyvinyl pyrazole, and their copolymers can be used.

As the gelatin, lime-treated gelatin, acid-treated gelatin, and enzyme-treated gelatin as mentioned in *Bull. Soc. Sci. Photography, Japan,* No. 16, p. 30, (1966) are also usable. Further, a hydrolysis product of gelatin and an enzymatic decomposition product of gelatin are also usable.

A photographic emulsion for use in the present invention may be sensitized chemically. For chemical sensitization, a sulfur sensitization method, a reduction sensitization method, a selenium sensitization method, a noble metal sensitization method and the like which are mentioned, for example, in *Die Gründlagen der Photographischen Prozesse mit Silberhalogeniden,* written by H. Frieser (Akademische Verlagsgesellschaft, 1968), pp.

675 to 734, can be used singly or in combination of two or more methods.

In sulfur sensitization, as a sulfur-containing compound capable of reacting with active gelatin or silver, that is, a sulfur sensitizer, thiosulfate, allylthiocarbamide, thiourea, allyl isothiocyanate, cystine, p-toluenethiosulfonate, Rhodan, a mercapto compound, or the like can be used. Besides the above, sulfur-containing compounds as mentioned in U.S. Pat. Nos. 1,574,944, 2,410,689, 2,278,947, 2,728,668 and 3,656,955 can also be used.

The added amount of the sulfur sensitizer varies depending on the conditions but the preferred amount of the sulfur sensitizer added is about from $10^{-7}$ to $10^{-2}$ mol based on 1 mol of silver.

A gold sensitizer in gold sensitization may have an oxidation number of gold of +1 or +3. As the gold sensitizer, chloroaurate, potassium chloroaurate, auric trichloride, potassium auric thiocyanate, potassium iodoaurate, tetracyanoauric acid, or the like can be used.

The added amount of the gold sensitizer varies depending on the conditions but the preferred amount of the gold sensitizer added is preferably about from $10^{-9}$ to $10^{-2}$ mol based on 1 mol of silver.

Selenium sensitization can also be used in the present invention and as the selenium sensitizer, aliphatic isoselenocyanates such as allyl isoselenocyanate, selenoureas, selenoketones, selenoamides, selenocarboxylic acids and their esters, selenophosphates, and selenides such as diethyl selenide and diethyl diselenide can be used. Specific examples of these selenium sensitizers are mentioned in U.S. Pat. Nos. 1,574,944, 1,602,592 and 1,623,499.

The added amount of selenium sensitizer is not especially limited but the amount of selenium sensitizer added is preferably from $10^{-7}$ to $10^{-2}$ mol based on 1 mol of silver.

Besides the above-mentioned sulfur sensitization, gold sensitization and selenium sensitization, a reduction sensitization method using a reducing substance (such as a stannous salt, amines, a hydrazine derivative, formamidine sulfinic acid, a silane compound, or the like), or a noble metal sensitization method using a noble metal compound (for example, a gold complex salt, a complex salt of a metal of Group VIII of the Periodic Table such as Pt, Ir, Pd or the like) can be used in combination.

The reduction sensitization method which can be used in the present invention is mentioned in U.S. Pat. Nos. 2,983,609, 2,419,974 and 4,054,458, and the noble metal sensitization method is mentioned in U.S. Pat. Nos. 2,399,083 and 2,448,060 and British Patent 618,061.

Further, as the combination of sensitizers, gold-sulfur sensitization and gold-selenium sensitization are typically used but other combinations can also be used. The ratio of gold sensitizer to sulfur sensitizer in the gold-sulfur sensitization varies depending on ripening conditions and the like but usually about from 1 to 1,000 mols of sulfur sensitizer is used per mol of the gold sensitizer.

With the gold-selenium sensitization, the preferred amount of selenium sensitizer is about from 1 to 1,000 mols based on 1 mol of the gold sensitizer.

In the gold-sulfur sensitization or the gold-selenium sensitization, a gold sensitizer may be added at the same time a sulfur sensitizer or a selenium sensitizer is added, or while the sulfur sensitization or selenium sensitization is carried out, or after the completion of the sulfur sensitization or selenium sensitization.

The especially preferred chemical sensitization for the present invention is sulfur sensitization or gold-sulfur sensitization.

These chemical sensitizers used in the present invention are added to a silver halide photographic emulsion by a conventional method. The water-soluble chemical sensitizer may be added as its aqueous solution. The chemical sensitizer soluble in an organic solvent may be added as its solution in an organic solvent such as methanol, ethanol, or the like which is easily mixed with water.

Conditions of chemical sensitization, for example, pH, pAg, temperature and the like are not especially limitative. It is general that the pH value is from 4 to 9, preferably from 5 to 8, the pAg value is from 5 to 11, preferably from 7 to 10, and the temperature is from 40° to 90° C., preferably from 45° to 75° C.

The chemical sensitization may be carried out in the presence of the well-known nitrogen-containing heterocyclic compound (British Patent 1,315,755 and Japanese Patent Application (OPI) Nos. 63914/75, 77223/76, 126526/83 and 215644/83).

A variety of compounds can be contained in the photographic emulsion used in the present invention with the aim of preventing fog forming during the manufacturing process, preservation, or photographic processing of the light-sensitive material, or the aim of stabilizing the photographic performance of the light-sensitive material. That is, various compounds known as an antifoggant or a stabilizer can be added such as azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), and the like; mercaptopyrimidines; mercaptotriazines; thioketo compounds such as oxazolinethione; azaindenes, e.g., triazaindenes, tetraazaindenes (in particular, 4-hydroxy-substituted-(1,3,3a,7)-tetraazaindenes), pentaazaindenes, and the like; benzenethiosulfonic acid; benzenesulfinic acid; benzenesulfonic acid amide; and the like. For example, compounds as mentioned in U.S. Pat. Nos. 3,954,474 and 3,982,947 and Japanese Patent Publication No. 28660/77 can be used.

With the aim of an increase in sensitivity or contrast or of promotion of development of the photographic light-sensitive material of the present invention, a polyalkylene oxide or its derivatives such as its ether, ester, amine, or the like, a thioether compound, thiomorpholines, quaternary ammonium chloride compounds, urethane derivatives, urea derivatives, imidazole derivatives, 3-pyrazolidones, or the like may be contained in the photographic emulsion layer of the light-sensitive material. For example, compounds as mentioned in U.S. Pat. Nos. 2,400,532, 2,423,549, 2,716,062, 3,617,280, 3,772,021 and 3,808,003 and British Patent 1,488,991 can be used.

A silver halide emulsion used in the present invention may be the surface latent image type in which a latent image is formed mainly on the surface of the particle, or the internal latent image type in which a latent image is formed mainly at the interior of the particle. A direct reversal emulsion having an internal latent image type emulsion and a nucleating agent combined can also be used. The internal latent image type emulsion which can be used in the direct reversal emulsion is mentioned in U.S. Pat. Nos. 2,592,250 and 3,761,276, Japanese Patent Publication No. 3534/83 and Japanese Patent Application (OPI) No. 136641/82. Nucleating agents suitable to combine with the above emulsion are mentioned in U.S. Pat. Nos. 3,227,552, 4,245,037, 4,255,511, 4,266,013 and 4,276,364 and West German Patent Application (OLS) No. 2,635,316.

Further, emulsions as mentioned in Japanese Patent Application (OPI) Nos. 143741/86, 112140/86, 137147/86, 148442/86, 258535/85, 195541/85, 192937/85, 125839/85, 182446/84 and 263937/85 can also be used preferably as the emulsion of the present invention.

In forming the light-sensitive material of the present invention, it is possible to form a light-sensitive layer by mixing different emulsions and it is also possible to produce the light-sensitive material having a multilayer constitution by applying different emulsions having the same color sensitivity range to form separate layers.

The silver halide used in the present invention may be spectrally sensitized by methine dyes or the like. The dyes which can be used for the spectral sensitization include a cyanine dye, a merocyanine dye, a complex cyanine dye, a complex merocyanine dye, a holopolar cyanine dye, a hemicyanine dye, a styryl dye, and a hemioxonol dye. A cyanine dye, a merocyanine dye and a complex merocyanine dye are preferable. Any of basic heterocyclic nuclei usually used in cyanine dyes can be applied to these dyes. That is, a pyrroline nucleus, an oxazoline nucleus, a thiazole nucleus, a selenazole nucleus, an imidazole nucleus, a tetrazole nucleus, a pyridine nucleus, and the like; nuclei having an alicyclic hydrocarbon ring fused with these nuclei; and nuclei having an aromatic hydrocarbon ring fused with these nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, and the like can be applied to these dyes. These nuclei may have a substituent at a position of the carbon atom contained therein.

As a nucleus having ketomethylene structure, a 5- or 6-membered heterocyclic nucleus such as a pyrazoline-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, or the like can be applied to the merocyanine dye and the complex merocyanine dye. These dyes are mentioned in Japanese Patent Application (OPI) Nos 180550/84 and 140335/85 and *Research Disclosure,* RD No. 17029, pp. 12 and 13 (June, 1978). Dyes mentioned as a thermally decolorable dye in Japanese Patent Application (OPI) No. 111239/85 can be used.

These sensitizing dyes may be used singly or in combination of two or more compounds, and a combination of sensitizing dyes is often used with the aim of supersensitization.

A substance which is a dye or a substance absorbing substantially no visible light having no spectral sensitizing effects itself but which shows supersensitization may be contained, together with a sensitizing dye, in a photographic emulsion of the present invention. For example, an aminostyryl compound substituted by a nitrogen-containing heterocyclic group (as mentioned, for example, in U.S. Pat. Nos. 2,933,390 and 3,635,721), a condensation product of aromatic organic acid with formaldehyde (as mentioned, for example, in U.S. Pat. No. 3,743,510), a cadmium salt, an azaindene compound, or the like may be contained in the emulsion Combinations as mentioned in U.S. Pat. Nos. 3,615,613, 3,615,641, 3,617,295 and 3,635,721 are especially useful.

To mix these sensitizing dyes in the silver halide photographic emulsion, they may be dispersed directly in the emulsion or they may be dissolved in a solvent or a mixed solvent such as water, methanol, ethanol, acetone, methyl cellosolve, and the like and then added to the emulsion. Further, after they are dissolved in a solvent such as phenoxyethanol or the like which is substantially immiscible with water, the solution obtained is dispersed into water or a hydrophilic colloid and then the resulting dispersion may be added to the emulsion.

Further, these sensitizing dyes can be mixed with a lipophilic substance such as a dye providing compound or the like and then the sensitizing dyes and the lipophilic substance can be added to the emulsion at the same time. When the sensitizing dyes are dissolved, they may be separately dissolved or they may be mixed with each other before being dissolved. When the sensitizing dyes are added to the emulsion, they may be added to the emulsion at the same time in the form of their mixture or may be added separately, or they may be added together with other additives. The sensitizing dyes may be added to the emulsion when it is chemically ripened or before or after it is chemically ripened, or they may be added before or after the formation of nuclei of silver halide particles, according to U.S. Pat. Nos. 4,183,756 and 4,225,665.

The amount of these sensitizing dyes added is, in general, about from $10^{-8}$ to $10^{-2}$ mol per mol of silver halide.

In the present invention, an organic metallic salt relatively stable to light can be used in combination as an oxidizing agent with light-sensitive silver halide. In this case, it is necessary that the light-sensitive silver halide and the organic metallic salt are in contact with each other or exist at a close distance.

As the organic metallic salts, an organic silver salt is used especially preferably.

Such an organic metallic salt is effective when the heat-developable light-sensitive material is developed by heating to a temperature of 50° C. or higher, preferably 60° C. or higher.

An organic compound usable for formation of the above-mentioned organic silver salt which is an oxidizing agent includes an aliphatic or aromatic carboxylic acid, a compound containing a mercapto group or a thiocarbonyl group having α-hydrogen, and an imino group-containing compound.

Typical examples of silver salts of aliphatic carboxylic acids include silver salts derived from behenic acid, stearic acid, oleic acid, lauric acid, capric acid, myristic acid, palmitic acid, maleic acid, fumaric acid, tartaric acid, furoinic acid, linolic acid, linolenic acid, adipic acid, sebacic acid, succinic acid, acetic acid, butyric acid, propiolic acid, and camphoric acid. Silver salts derived from these fatty acids substituted by a halogen atom or a hydroxyl group, and those derived from aliphatic carboxylic acids having a thioether group can also be used.

Examples of silver salts of aromatic carboxylic acids and of other compounds containing a carboxylic group include silver salts derived from benzoic acid, 3,5-dihydroxybenzoic acid, o-, m-, or p-methylbenzoic acid, 2,4-dichlorobenzoic acid, acetamide benzoic acid, p-phenylbenzoic acid, gallic acid, tannic acid, phthalic acid, terephthalic acid, salicyclic acid, phenylacetic acid, pyromellitic acid, 3-carboxymethyl-4-methyl-4-thiazoline-2-thione, and the like. Examples of the silver salt of compounds having a mercapto or thiocarbonyl group include silver salts derived from 3-mercapto-4-phenyl-1,2,4-triazole, 2-mercaptobenzimidazole, 2-mercapto-5-aminothiazole, 2-mercaptobenzothiazole, S-alkylthioglycolic acid (containing an alkyl group having from 12 to 22 carbon atoms), dithiocarboxylic acids such as dithioacetic acid and the like, thioamides such as thiostearoamide, a mercapto compound such as 5-carboxy-1-methyl-2-phenyl-4-thiopyridine, mercaptotriazine, 2-mercaptobenzoxazole, mercaptooxadiazole, and 3-amino-5-benzylthio-1,2,4-triazole which are mentioned in U.S. Pat. No. 4,123,274.

Examples of silver salts of compounds having an imino group include silver salts derived from benzotriazole and its derivatives, for example, benzotriazole, alkyl-substituted benzotriazoles such as methylbenzotriazole and the like, halogen-substituted benzotriazoles such as 5-chlorobenzotriazole and the like, and carboimide benzotriazoles such as butylcarboimide benzotriazole which are mentioned in Japanese Patent Publication Nos. 30270/69 and 18416/70, nitrobenzotriazoles as mentioned in Japanese Patent Application (OPI) No. 118639/83, sulfobenzotriazole, carboxybenzotriazole and its salt, and hydroxybenzotriazole as mentioned in Japanese Patent Application (OPI) No. 118638/83, 1,2,4-triazole and 1H-tetrazole, carbazole, saccharin, imidazole and its derivatives, and the like as mentioned in U.S. Pat. No. 4,220,709.

Silver salts and other organic metallic salts such as copper stearate which are mentioned in *Research Disclosure,* RD No. 17029 (June, 1978) and U.S. Pat. No. 4,500,626, and the silver salt of carboxylic acid having a phenyl group such as phenyl propiolic acid mentioned in Japanese Patent Application (OPI) No. 113235/85 can also be used in the present invention.

The above-mentioned organic metallic salts can be used in combination with the light-sensitive silver halide in an amount of from 0.01 to 10 mols, preferably from 0.01 to 1 mol, based on 1 mol of the silver halide. The total coated weight of the light-sensitive silver halide and the organic metallic salt is from 50 mg to 10 $g/m^2$.

In the present invention, as a substance for forming an image, silver can be used. The light-sensitive silver halide of the present invention is reduced to silver at an elevated temperature. A substance which produces or releases a mobile dye corresponding or countercorresponding to the above-mentioned reduction reaction, that is, a dye providing substance can also be used.

The dye providing substance which can be used in the present invention will be described hereinafter.

Couplers capable of reacting with a developing agent can be used as the dye providing substances usable in the present invention. In a method using a coupler, an oxidant of the developing agent formed by the reduction oxidation reaction of a silver salt with the developing agent reacts with the coupler to form a dye, and the method is mentioned in many references. Specific examples of developing agents and couplers are described in detail in *The Theory of the Photographic Process,* written by T. H. James, 4th Ed., pp. 291 to 334 and pp. 354 to 361, and Japanese Patent Application (OPI) Nos. 123533/83, 149046/83, 149047/83, 111148/84, 124339/84, 174835/84, 231539/84, 231540/84, 2950/85, 2951/85, 14242/85, 23474/85 and 66249/85.

Further, a dye-silver compound having an organic silver salt combined with a dye can also be used as the dye providing substance. Specific examples of dye-silver compounds are mentioned in *Research Disclosure,* May, 1978, pp. 54 to 58 (RD No. 16966).

An azo dye used in a heat development silver dye bleaching process can also be used as the dye providing substance. Specific examples of azo dyes and bleaching processes are mentioned in U.S. Pat. No. 4,235,957 and *Research Disclosure,* April, 1976, pp. 30 to 32 (RD No. 14433).

Further, leuco dyes as mentioned in U.S. Pat. Nos. 3,985,565 and 4,022,617 can also be used as the dye providing substance.

A compound having the function of imagewise releasing or diffusing a diffusible dye can be used as the dye providing substance.

A compound of this type can be, in general, represented by the following formula (LI):

$$(\text{Dye}—X)_n—Y \qquad \text{(LI)}$$

wherein Dye represents a dye group, a dye group temporarily shifted to a short wavelength, or a dye precursor; X represents a chemical bond or a linking group; and Y represents a group having such properties as to cause a difference in the diffusibility of a compound represented by $(\text{Dye}—X)_n—Y$ corresponding or countercorresponding to a light-sensitive silver salt having a latent image, or a group having such properties as to release Dye corresponding or countercorresponding to the above-mentioned light-sensitive silver salt and to cause a difference in diffusibility between the released Dye and the $(\text{Dye}—X)_n—Y$; n represents 1 or 2, and when n is 2, two groups represented by Dye—X may be the same or different.

Specific examples of dye providing substances represented by formula (LI) include dye developers having a dye component connected with a hydroquinone developing agent mentioned in U.S. Pat. Nos. 3,134,764, 3,362,819, 3,597,200, 3,544,545 and 3,482,972, a substance releasing a diffusible dye by an intramolecular nucleophilic substitution reaction mentioned in Japanese Patent Application (OPI) No. 63618/76, and a substance releasing a diffusible dye by the intramolecular rearrangement reaction of an isoxazolone ring mentioned in Japanese Patent Application (OPI) No. 111628/74. In all these methods, a diffusible dye is released or diffused in portions where development does not take place and a dye is neither released nor diffused in portions where development takes place.

Further, as another method, a method has been devised in which a dye releasing substance is transformed to an oxidant type having no ability of releasing a dye to allow it to coexist with a reducing agent or its precursor, and, after the development is carried out, the oxidant type is reduced by the residual reducing agent to allow the dye releasing substance to release a diffusible dye. Specific examples of the dye providing substances used in this method are mentioned in Japanese Patent Application (OPI) Nos. 110827/78, 130927/79, 164342/81 and 35533/78.

As a substance releasing a diffusible dye in the portions where development takes place, a substance releasing a diffusible dye by the reaction of a coupler having a diffusible dye as a releasing group with the oxidant of the developing agent is mentioned in British Patent 1,330,524, Japanese Patent Publication No. 39165/73 and U.S. Pat. No. 3,443,940, and a substance forming a diffusible dye by the reaction of a coupler having a nondiffusible group as a releasing group with the oxidant of the developing agent is mentioned in U.S. Pat. No. 3,227,550.

With methods using these color developing agents, contamination of an image due to the oxidant of the developing agents comes into serious problem. Therefore, a dye providing substance requiring no developing agent and having reducing properties by itself has been devised with the aim of alleviating the contamination problem. Representative examples of the substance are dye providing substances as mentioned in U.S. Pat. Nos. 3,928,312, 4,053,312, 4,055,428 and 4,336,322, Japanese Patent Application (OPI) Nos. 65839/84, 69839/84, 3819/78, and 104343/76, *Research Disclosure,* RD No.17465, U.S. Pat. Nos. 3,725,062, 3,728,113 and 3,443,939, Japanese Patent Application (OPI) Nos. 116537/83 and 179840/82, and U.S. Pat. No. 4,500,626.

Specific examples of the dye providing substances usable in the present invention include substances as mentioned in the above-mentioned U.S. Pat. No. 4,500,626. Of the substances, substances (1) to (3), (10) to (13), (16) to (19), (28) to (30), (33), (35), (38) to (40) and (42) to (64) as mentioned in the above-mentioned U.S. Pat. No. 4,500,626 are preferred. Further, substances as mentioned in Japanese Patent Application (OPI) No. 124941/86 are also preferred.

Hydrophobic additives such as the above-mentioned dye providing substance and an image formation accelerator to be described later can be introduced into layers of the light-sensitive material by a conventional process such as a process as mentioned, e.g., in U.S. Pat. No. 2,322,027. In this process, high boiling point organic solvents as mentioned in Japanese Patent Application (OPI) Nos. 83154/84, 178451/84, 178452/84, 178453/84, 178454/84, 178455/84 and 178457/84 can be used in combination with a low boiling point organic solvent having a boiling point of from 50° C. to 160° C., if required.

The amount of the high boiling point organic solvent used is 10 g or less, preferably 5 g or less, based on 1 g of a dye providing substance used.

A dispersing method for a dye providing substance by using a polymer as mentioned in Japanese Patent Publication No. 39853/76 or in Japanese Patent Application (OPI) No. 59943/76 can also be used.

With a compound substantially insoluble in water, besides the above-mentioned methods, the compound can be dispersed and contained, as fine particles, in a binder. Further, when a hydrophobic substance is dispersed in a hydrophilic colloid, a variety of surface active agents can be used As the surface active agent, those as mentioned in Japanese Patent Application (OPI) No. 157636/84 can be used.

It is preferred that a reducing agent is contained in the light-sensitive material of the present invention. The reducing agent includes, in addition to the conventional reducing agents, the above-mentioned dye providing substance having reducing properties.

Further, a reducing agent precursor having no reducing properties by itself but manifesting reducing properties by the effect of a nucleophilic reagent or heat in a development process can be used.

Examples of the reducing agents usable in the present invention include reducing agents as mentioned in U.S. Pat. Nos. 4,500,626 and 4,483,914, and Japanese Patent Application (OPI) Nos. 140335/85, 128438/85, 128436/85, 128439/85 and 128437/85. Further, reducing agent precursors as mentioned in Japanese Patent Application (OPI) Nos. 138736/81 and 40245/82, and U.S. Pat. No. 4,330,617 can also be used.

Such a combination of various developing agents as disclosed in U.S. Pat. No. 3,039,869 can also be used.

The amount of the reducing agent added in the present invention is preferably from 0.01 to 20 mols, more preferably from 0.1 to 10 mols, based on mol of silver.

It is possible to use an image formation accelerator in the light-sensitive material of the present invention. The image formation accelerator has functions of accelerating the reduction oxidation reaction of a silver salt oxidizing agent and a reducing agent, of accelerating a reaction of dye formation or dye destruction from a dye providing substance or a reaction of releasing a mobile dye from a dye providing substance, and of accelerating the transfer of a dye from the light-sensitive element to a dye fixing layer of the dye fixing element. The image formation accelerator is classified from its physicochemical functions into a base or base precursor, a nucleophilic compound, a high boiling point organic solvent (oil), a heat solvent, a surface active agent, a compound having an interaction with silver or silver ions, and the like. However, these substances have, in general, a multiple function and it is usual that they have a combination of some of the above-mentioned accelerating effects.

The above-mentioned substances are described in detail in U.S. Pat. No. 4,500,626.

In the present invention, it is possible to use a variety of development stopping agents in order to obtain a constant image in spite of a fluctuation in processing temperatures and in a processing time when a light-sensitive material is developed.

The development stopping agent used herein is a compound which stops the development by neutralizing the base or by reacting with the base rapidly after the proper development and lowering the concentration of base, or a compound which restrains the development by interacting with silver and a silver salts. Specific examples of the development stopping agent include an acid precursor releasing an acid by heat, an electrophilic compound which causes a substitution reaction with a coexistent base by heat, a nitrogen-containing heterocyclic compound, a mercapto compound and its precursors, and the like (which are mentioned, for example, in Japanese Patent Application (OPI) Nos 192939/85, 230133/85, 230134/85).

Compounds releasing a mercapto compound by heat are also useful. Examples thereof include compounds as mentioned, for example, in Japanese Patent Application (OPI) No. 53632/86.

In the present invention, a substance promoting activation of development and, at the same time, stabilization of image can be used in the light-sensitive material. Specific examples of such substances preferably used are mentioned in U.S. Pat. No. 4,500,626.

A variety of antifoggants can be used in the present invention. As the antifoggant, azoles, nitrogen-containing carboxylic acids or phosphoric acids as mentioned in Japanese Patent Application (OPI) No. 168442/84, or a mercapto compound or its metallic salt as mentioned in Japanese Patent Application (OPI) No. 111636/84 can be used.

In the present invention, an image toning agent can be contained in the light-sensitive material, as required Specific examples of useful toning agents are mentioned in U.S. patent application Ser. No. 809,627, filed on Dec. 16, 1985.

The binder used in the light-sensitive material of the present invention may be used singly or in combination of two or more binders. As the binder, a hydrophilic binder can be used. Typical examples of the hydrophilic binder are transparent or translucent hydrophilic binders, including natural substances, for example, proteins such as gelatin, gelatin derivatives, cellulose derivatives, and the like, and polysaccharides such as starch, gum arabic, and the like, and synthetic polymeric substances, for example, water-soluble polyvinyl compounds such as polyvinyl pyrrolidone, polyacrylamide polymers, and the like. Synthetic polymeric substances, such as a dispersed polyvinyl compound in the form of latex, which is used with the aim of, in particular, increasing the dimensional stability of photographic materials can also be used.

The coated weight of the binder in the present invention is preferably 20 $g/m^2$ or less, more preferably 10 $g/m^2$ or less, particularly preferably 7 $g/m^2$ or less.

The amount of the high boiling point organic solvent which is dispersed together with hydrophobic compounds such as the dye providing substance and the like in the binder is preferably 1 cc or less, more preferably 0.5 cc or less, particularly preferably 0.3 cc or less, based on 1 g of the binder.

An inorganic or organic hardener may be contained within the photographic emulsion layers and other binder layers of the light-sensitive element and the dye fixing element of the present invention.

Specific examples of the hardener are mentioned in Japanese Patent Application (OPI) Nos. 147244/86 and 157636/84. These hardening agents can be used singly or in combination of two or more.

A support used in the light-sensitive material of the present invention is able to stand a processing temperature. Examples thereof include not only glass, paper, a polymer film, a metal and the like but also materials as mentioned in Japanese Patent Application (OPI) No. 147244/86.

If a colored dye providing substance is contained in the light-sensitive material used in the present invention, it is not so necessary that an irradiation preventing substance, a halation preventing substance or various dyes are further contained in the light-sensitive material. However, a filter dye, an absorbing substance and the like which are mentioned in Japanese Patent Application (OPI) No. 147244/86 can be contained in the light-sensitive material.

To obtain an extensive range of color in a chromaticity diagram by using three primary colors of yellow, magenta and cyan, it is necessary that the light-sensitive element used in the present invention has at least three silver halide emulsion layers each having sensitivity in different spectral regions.

A representative combination of at least three silver halide emulsion layers each having sensitivity in spectral regions different from each other is mentioned in Japanese Patent Application (OPI) No. 180550/84.

The light-sensitive element used in the present invention may have two or more emulsion layers having sensitivity in the same spectral region but each having sensitivity different from each other.

The light-sensitive element used in the present invention can contain, as required, a variety of additives and of layers other than the photosensitive layer, for example, an antistatic layer, an electroconductive layer, a protective layer, an intermediate layer, an antihalation layer, a peeling-off layer, a matting layer, and the like which are used conventionally in a heat-developable light-sensitive material. As the various additives, additives as mentioned in *Research Disclosure,* Vol. 170, June, 1978, RD No. 17029 and Japanese Patent Application (OPI) No. 88256/86, for example, a plasticizer, a dye for improving sharpness, an antihalation dye, a sensitizing dye, a matting agent, a surface active agent, a fluorescent whitening agent, an ultraviolet ray absorbing agent, a slipping agent, an antioxidant, a discoloration preventing agent, and the like.

In particular, in the protective layer, an organic or inorganic matting agent is usually present to prevent the layer from sticking. Further, a mordant, an ultraviolet ray absorbing agent, and the like may be contained in the protective layer. The protective layer and the intermediate layer each may be composed of two or more layers.

In the intermediate layer, a reducing agent, an ultraviolet ray absorbing agent, and white pigments such as $TiO_2$ may further be present to prevent a color mixing. White pigments may be added not only to the intermediate layer but also to the emulsion layer with the aim of an increase in sensitivity.

The light-sensitive material of the present invention may comprise a light-sensitive element forming or releasing a dye by heating and a dye fixing element for fixing the dye thus formed or released, the dye fixing element being disposed as required.

In a system in which an image is formed by diffusion transfer of a dye, a light-sensitive element and a dye fixing element are essential, and the representative construction of such system is broadly divided into a form in which the light-sensitive element and the dye fixing element are separately applied and disposed on two supports and a form in which the light-sensitive element and the dye fixing element are applied and disposed on the same support.

The relation between the light-sensitive element and the dye fixing element, the relation between the support and each of the two elements, and the relation between a white reflection layer and each of the two elements which are mentioned in Japanese Patent Application (OPI) No. 147244/86 and U.S. Pat. No. 4,500,626 can be applied to the present invention.

In one representative example of the form in which the light-sensitive element and the dye fixing element are applied and disposed on the same support, after a transferred image is formed, the light-sensitive element need not be peeled off from the dye fixing element. In this case, the light-sensitive layer, the dye fixing layer and the white reflection layer are laminated on a transparent or opaque support. Examples of the construction thereof include a transparent or opaque support/light-sensitive layer/white reflection layer/dye fixing layer, a transparent support/dye fixing layer/white reflection layer/light-sensitive layer, and the like.

In other example of the form in which the light-sensitive element and the dye fixing element are applied and disposed on the same support, the light-sensitive element is partially or wholly peeled off from the dye fixing element, and a peeling off layer is applied and disposed at an appropriate position, as mentioned in Japanese Patent Application (OPI) No. 67840/81, Canadian Patent 674,082 and U.S. Pat. No. 3,730,718.

The light-sensitive element and the dye fixing element of the present invention may have an electroconductive layer as a heating means for heat development or for diffusion transfer of dye. As the transparent or opaque electroconductive layer, a conventional resistance heating element can be used.

For producing such resistance heating element, a method using an inorganic material film having semiconductivity and a method using an organic substance film having electroconductive fine particles dispersed therein can be used. Materials able to be used in these methods are mentioned in Japanese Patent Application (OPI) No. 29835/86.

The dye fixing element used in the present invention has at least one dye fixing layer containing a mordant, and when the dye fixing layer is positioned on the surface of the dye fixing element, a protective layer can further be disposed thereon, if necessary.

The layer constitution, the binder, and the additives of the dye fixing element, an addition method for a mordant, and the position of the mordant added are mentioned in Japanese Patent Application (OPI) No. 147244/86, and those can also be applied to the present invention.

In the dye fixing element used in the present invention, in addition to the above-mentioned layers, auxiliary layers such as a peeling off layer, a matting layer, a curl preventing layer, and the like can be disposed as required.

In one or more of the above-mentioned layers, a base and/or a base precursor for promotion of dye transfer, a hydrophilic heat solvent, a discoloring preventing agent for preventing the discoloring of dye, an ultraviolet ray absorbing agent, a slipping agent, a matting agent, an antioxidant, a dispersed vinyl compound for increasing the dimensional stability, a fluorescent whitening agent, and the like may be present. Specific examples of these additives are mentioned in *Research Disclosure,* Vol. 170, June, 1978, RD No. 17029 and Japanese Patent Application (OPI) No. 88256/86.

A binder used in the above-mentioned layers is preferably a hydrophilic binder and representative examples thereof include a transparent or translucent hydrophilic colloid. Specifically, the above-mentioned binders for light-sensitive material can be used.

The dye fixing layer as an image receiving layer of the present invention may be the dye fixing layer used in the conventional heat-developable color light-sensitive material, and a mordant used in the dye fixing layer can be selected arbitrarily from among the conventional mordants. Of those, a polymer mordant is especially preferred, and examples thereof include a polymer containing a tertiary amino group, a polymer having a nitrogen-containing heterocyclic ring, a polymer containing a quaternary cationic group and the like.

Specific examples of the polymer mordant are mentioned in Japanese Patent Application (OPI) No. 147244/86 and U.S. Pat. No. 4,500,626.

As the coating method for the light-sensitive layer, the protective layer, the intermediate layer, the subbing layer, the backing layer, and the like of the present invention, methods as mentioned in U.S. Pat. No. 4,500,626 can be applied. As a light source for imagewise exposure to record an image on the heat-developable light-sensitive material of the present invention, radiation including visible light can be used, and, for example, light sources as mentioned in Japanese Patent Application (OPI) No. 147244/86 and U.S. Pat. No. 4,500,626 can be used.

The present invention will now be described by reference to specific examples which are not meant to be limiting.

Unless otherwise specified, all ratios, percents, etc., are by weight.

EXAMPLE 1

Method for Preparing Emulsions 1 and 2

To an aqueous gelatin solution under stirring (prepared by dissolving 20 g of gelatin, 2 g of sodium chloride, 0.015 g of a compound

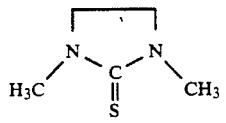

and 1 g of a compound

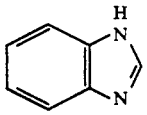

in 600 ml of water and being maintained at 75° C. by heating), 600 ml of an aqueous solution containing 0.68 mol of potassium bromide and 600 ml of an aqueous solution containing 0.59 mol of silver nitrate were added over 70 minutes with the pAg controlled at 8.3 (the whole of the silver nitrate solution was added) and thus monodispersed tetradecahedron particles of silver bromide having a particle size of 0.6 μm were formed. In this process, at the same time the silver halide particles were formed, a solution prepared by dissolving 0.16 g of Dye (A) in 160 cc of methanol began to be added to the above-mentioned aqueous gelatin solution over 60 minutes. After washing with water and desalting, 25 g of gelatin and 150 ml of water were added to the mixture, and its pH value and pAg were controlled to 6.4 and to 8.3, respectively. The yield of the resulting emulsion was 700 g.

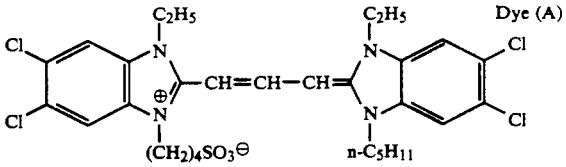

The emulsion was equally divided into two portions each weighing 350 g.

One portion was optimally sulfur-gold sensitized with sodium thiosulfate and chloroauric acid at 60° C. for 45 minutes. The emulsion obtained was taken as Emulsion 1.

To the other portion, 0.06 g of a compound

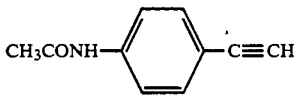

dissolved in methanol was added, and after that, the resulting mixture was optimally sulfur-gold sensitized with sodium thiosulfate and chloroauric acid at 60° C. for 45 minutes. The emulsion obtained was taken as Emulsion 2.

Method for Preparing Emulsions 3 and 4

To an aqueous gelatin solution under stirring (prepared by dissolving 20 g of gelatin, 1.2 g of potassium bromide, and 0.45 g of a compound $HO(CH_2)_2S(CH_2)_2S(CH_2)_2OH$ in 600 ml of water and being maintained at 50° C. by heating), 600 ml of an aqueous solution containing 0.59 mol of silver nitrate and 800 ml of an aqueous solution containing 0.75 mol of potassium bromide and 0.038 mol of potassium iodide were added over 50 minutes with the pAg controlled to 8.2 (under condition that the whole of the aqueous silver nitrate solution was added), and thus an emulsion of monodispersed cubic silver iodobromide particles (iodide content: 4.8 mol %) having a particle size of 0.4 μm was prepared. In this process, at the same time the halogen solution and the silver nitrate solution began to be added to the aqueous gelatin solution, a solution prepared by dissolving 0.15 g of Dye (B) in 75 ml of methanol began to be added over 25 minutes. After washing with water and desalting, 25 g of gelatin and 150 ml of water were added thereto, and its pH value and pAg were controlled to 6.5 and 8.3, respectively. The yield of the resulting emulsion was 700 g.

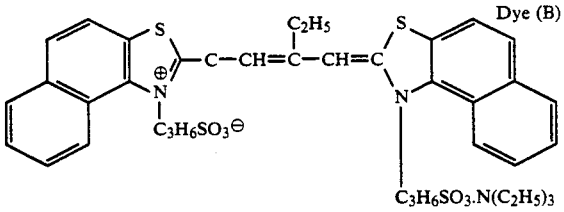

The emulsion was equally divided into two portions each weighing 350 g.

To one portion, sodium thiosulfate was added and the chemical sensitization was carried out at 60° C. for 30 minutes to carry out the optimum sulfur sensitization. The emulsion obtained was taken as Emulsion 3.

To the other portion, 0.06 g of a compound

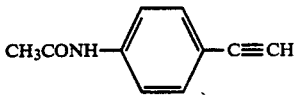

dissolved in methanol was added, and after that, the resulting mixture was optimally sulfur sensitized with sodium thiosulfate at 60° C. for 30 minutes. The emulsion obtained was taken as Emulsion 4.

Method for Preparing Emulsions 5 and 6

To an aqueous gelatin solution under stirring (prepared by dissolving 20 g of gelatin and 2 g of sodium chloride in 1,000 ml of water and then being maintained at 75° C.), 600 ml of an aqueous solution containing 0.59 mol of silver nitrate and 600 ml of an aqueous solution containing 0.47 mol of potassium bromide, 0.12 mol of sodium chloride, and $1.2\times10^{-8}$ mol of iridium ions (by use of $K_2IrCl_6$) were added at the same time at an equal flowing rate over 60 minutes. After washing with water and desalting, 25 g of gelatin and 200 ml of water were added and its pH value and pAg were controlled to 6.4 and to 7.8, respectively. The yield of the resulting emulsion was 700 g. The resulting emulsion contained monodispersed cubic particles having a particle size of 0.4 μm. The emulsion was equally divided into two portions each weighing 350 g.

One portion was optimally sulfur sensitized with triethyl thiourea at 60° C. for 30 minutes. After completion of chemical ripening of the emulsion, 0.1 g of a compound

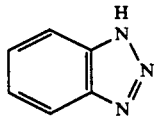

was added to the emulsion. The thus obtained emulsion was taken as Emulsion 5.

To the other portion, 0.01 g of a compound,

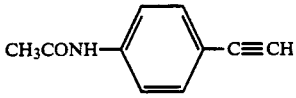

dissolved in methanol was added, and after that, the mixture was optimally sulfur sensitized with triethyl thiourea at 60° C. for 30 minutes. Similarly to Emulsion 5, after completion of chemical aging of the emulsion, 0.1 g of a compound

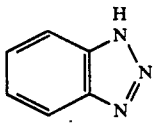

was added to the emulsion. The thus obtained emulsion was taken as Emulsion 6.

Method for Preparing an Organic Silver Salt Organic Silver Salt (1)

A method for preparing a benzotriazole silver emulsion as Organic Silver Salt (1) is described.

28 g of gelatin and 13.2 g of benzotriazole were dissolved in 300 ml of water, and the solution was maintained at 40° C. under stirring. An aqueous solution prepared by dissolving 17 g of silver nitrate in 100 ml of water was added to the above-mentioned solution over 2 minutes.

The pH value of the benzotriazole silver emulsion thus obtained was adjusted to precipitate and remove the excessive salt. After that, the pH value was controlled to 6.3 and 400 g of benzotriazole silver emulsion was obtained.

Organic Silver Salt (2)

20 g of gelatin and 5.9 g of 4-acetylaminophenyl propiolic acid were dissolved in a solution prepared by mixing 1,000 ml of a 0.1% aqueous solution of sodium hydroxide and 200 ml of ethanol, and the resulting solution was maintained at 40° C. under stirring.

An aqueous solution prepared by dissolving 4.5 g of silver nitrate in 200 ml of water was added to the above-mentioned solution over 5 minutes.

The pH value of the suspension was adjusted to precipitate and remove the excessive salt. After that, the pH value was controlled to 6.3, and 300 g of a dispersion of Organic Silver Salt (2) was obtained.

Method for Preparing Gelatin Dispersions of Dye-Providing Substances mixture was dispersed with a homogenizer at 10,000 rpm for 10 minutes. Thus, a dispersion of Yellow Dye Providing Substance (A) was obtained.

By the same process as the above except that Magenta Dye Providing Substance (B) was used and 7.5 g of tricresyl phosphate as a high boiling point solvent was used, a dispersion of Magenta Dye Providing Substance (B) was obtained.

By the same process as the process for preparing the dispersion of Yellow Dye Providing Substance (A) except that Cyan Dye Providing Substance (C) was used, a dispersion of Cyan Dye Providing Substance (C) was prepared.

Yellow Dye Providing Substance (A)

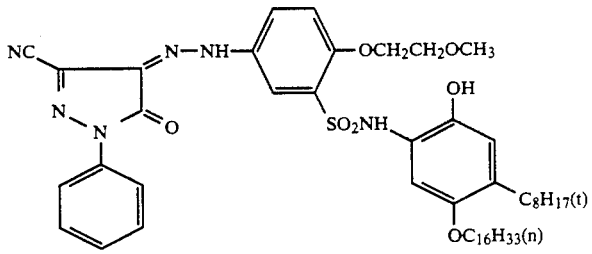

Magenta Dye Providing Substance (B)

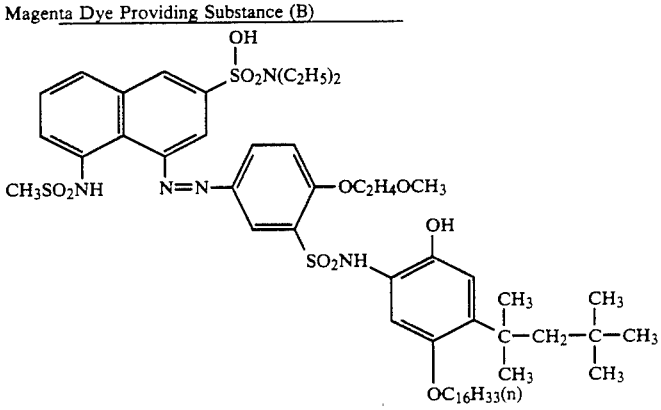

Cyan Dye Providing Substance (C)

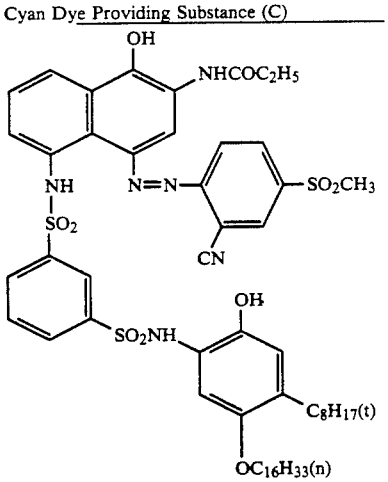

To 5 g of Yellow Dye-Providing Substance (A), 0.5 g of 2-ethylhexyl succinate sodium sulfonate as a surface active agent, 10 g of triisononyl phosphate and 30 ml of ethyl acetate were added. The mixture was heated to about 60° C. to prepare a uniform solution. This solution and 100 g of a 10% aqueous solution of lime-treated gelatin were mixed under stirring and after that, the Light-Sensitive Elements 1 and 2 having a construction shown below were produced by using the above-mentioned emulsions according to Table 1 below.

Seventh Layer: Protective Layer gelatin (350 mg/m$^2$), silica*6 (100 mg/m$^2$)

Sixth Layer: Protective Layer gelatin (500 mg/m$^2$), hardener*2 (10 mg/m$^2$)

Fifth Layer: Green-Sensitive Emulsion Layer
Emulsion 1 or 2 (400 mg/m$^2$ as silver), Organic Silver Salt (1) (50 mg/m$^2$ as silver), Organic Silver Salt (2) (50 mg/m$^2$ as silver), hardener*2 (16 mg/m$^2$), Yellow Dye Providing Substance (A) (400 mg/m$^2$), gelatin (1,000 mg/m$^2$), high boiling point solvent*3 (200 mg/m$^2$), surface active agent*4 (100 mg/m$^2$)

Fourth Layer: Intermediate Layer
gelatin (700 mg/m$^2$), hardener*2 (18 mg/m$^2$)

Third Layer: Red-Sensitive Emulsion Layer
Emulsion 3 or 4 (300 mg/m$^2$ as silver), Organic Silver Salt (1) (50 mg/m$^2$ as silver), Organic Silver Salt (2) (50 mg/m$^2$ as silver), hardener*2 (18 mg/m$^2$), Magenta Dye Providing Substance (B) (400 mg/m$^2$), gelatin (1,000 mg/m$^2$), high boiling point solvent*5 (200 mg/m$^2$), surface active agent*4 (100 mg/m$^2$)

Second Layer: Intermediate Layer
gelatin (800 mg/m$^2$), hardener*2 (16 mg/m$^2$)

First Layer: Infrared-Sensitive Emulsion Layer
Emulsion 5 or 6 (300 mg/m$^2$ as silver), Organic Silver Salt (1) (50 mg/m$^2$ as silver), Organic Silver Salt (2) (50 mg/m$^2$ as silver), sensitizing dye*1 ($10^{-7}$ mol/m$^2$), hardener*2 (16 mg/m$^2$), Cyan Dye Providing Substance (C) (300 mg/m$^2$), gelatin (1,000 mg/m$^2$), high boiling point solvent*3 (150 mg/m$^2$), surface active agent*4 (100 mg/m$^2$)

Support

Sensitizing Dye*1

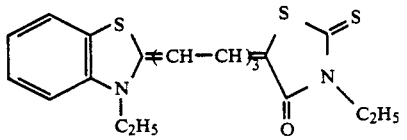

Hardener*2
1,2-Bis(vinylsulfonylacetamido)ethane

High Boiling Point Solvent*3
(iso—$C_9H_{19}O)_3P$=O

Surface Active Agent*4

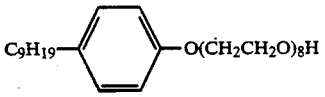

High Boiling Point Solvent*5
Tricresyl phosphate

Silica*6
A size of 4 μm

TABLE 1

| | Light-Sensitive Element 1 | Light-Sensitive Element 2 |
|---|---|---|
| First Layer (infrared-sensitive emulsion layer) | Emulsion 5 | Emulsion 6 |
| Third Layer (red-sensitive emulsion layer) | Emulsion 3 | Emulsion 4 |
| Fifth Layer (green-sensitive emulsion layer) | Emulsion 1 | Emulsion 2 |

Method for Producing a Dye Fixing Element 63 g of gelatin, 130 g of a mordant having the structure set forth below, and 40 g of guanidine carbonate were dissolved in 1,300 ml of water, and the resulting solution was coated on a paper support laminated with polyethylene to have a wet thickness of 42 μm and then dried.

Mordant

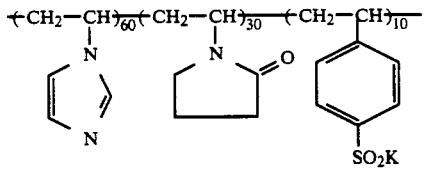

On the coated layer, an aqueous solution prepared by dissolving 35 g of gelatin, and 1.05 g of 1,2-bis(vinylsulfonylacetamido)ethane in 800 ml of water was applied to have a wet thickness of 17 μm and then dried. Thus, a dye fixing element was obtained.

The above-mentioned Light-Sensitive Elements 1 and 2 having multilayer constitution was exposed to light for $10^{-4}$ second by using a xenon flash tube through a separation filter for G, R and IR each having a continuously changing density (composed of a band pass filter for G of 500 to 600 nm, a band pass filter for R of 600 to 700 nm, and a filter for transmission of IR of 700 nm or more).

On the surface of the emulsion layer of Light-Sensitive Elements after being exposed, water was supplied with a wire bar in an amount of 10 ml/m$^2$, and then dye fixing element was superimposed thereon, so that the surface of the emulsion layer was in direct contact with the surface of the coated layer of the dye fixing element. The thus-superimposed material was heated with a heat roller to the temperature of the coated layer of 87° C. or 97° C. for 20 seconds. After that, the light-sensitive element was peeled off from the dye fixing element. On the dye fixing element, clear image of yellow, magenta and cyan was obtained corresponding to a separation filter for G, R and IR.

Relative sensitivity and fog density were measured. The results obtained are shown in Table 2.

TABLE 2

| | | Relative Sensitivity Treatment Temperature | | Fog Density Treatment Temperature | |
|---|---|---|---|---|---|
| | | 87° C. | 97° C. | 87° C. | 97° C. |
| Light-Sensitive Element 1 (Comparison) | Yellow | 100* | 90 | 0.15 | 0.30 |
| | Magenta | 100* | 99 | 0.13 | 0.25 |
| | Cyan | 100* | 93 | 0.12 | 0.26 |
| Light-Sensitive Element 2 (Invention) | Yellow | 110 | 105 | 0.14 | 0.18 |
| | Magenta | 100 | 100 | 0.13 | 0.18 |
| | Cyan | 100 | 105 | 0.11 | 0.15 |

*The relative sensitivity of Light-Sensitive Element 1 treated at 87° C. was taken as 100.
The relative sensitivity was investigated at a fog of +0.3.

From Table 2, it is found that the light-sensitive element in which the acetylene compound of the present invention was added in chemical ripening process has a low fog density and a small fluctuation in sensitivity, in particular, when processed at a high temperature. In the image obtained by using Light-Sensitive Element 1 (comparison), unevenness in density (nearly round portions of about 10 μm to 1 mm diameter having a density of extremely low) was observed, but in an image obtained by using Light-Sensitive Element 2, such unevenness in density was not found.

EXAMPLE 2

Method for Preparing Emulsion 7

To an aqueous gelatin solution under stirring (prepared by dissolving 20 g of gelatin, 0.5 g of KBr, and 0.35 g of a compound $HO(CH_2)_2S(CH_2)_2S(CH_2)_2OH$ in 600 ml of water and being maintained at 75° C.), 160 ml of an aqueous solution containing 0.11 mol of potassium bromide and 0.007 mol of potassium iodide and 160 ml of an aqueous solution containing 0.12 mol of silver nitrate were added over 30 minutes. After the gelatin solution was allowed to stand for 2 minutes after the completion of addition of the above-mentioned solutions, 450 ml of an aqueous solution containing 0.48 mol of potassium bromide and 450 ml of an aqueous solution containing 0.47 mol of silver nitrate were added over 30 minutes by a controlled double jet method with pAg maintained to 7.6. (The whole of the aqueous solution of silver nitrate was added.) After silver halide particles were formed, 40 cc of a 1% aqueous solution of potassium iodide was added, and further, 0.16 g of Dye (C) dissolved in 200 cc of methanol was added. After the addition of the potassium iodide solution and Dye (C), the reaction mixture was allowed to stand at 75° C. for 10 minutes. After washing with water and desalting, 25 g of gelatin and 150 ml of water were added to the mixture to adjust the pH value and pAg to 6.4 and 8.4, respectively. The yield of the resulting emulsion was 700 g. The resulting particles were monodispersed cubic particles having a particle size of 0.7 μm and the distribution of halogen within the individual particle was not uniform.

Dye (C)

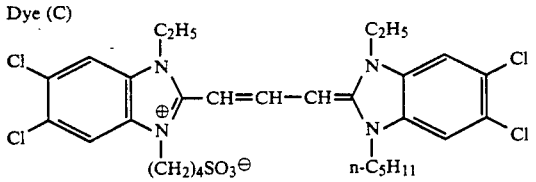

0.1 g of 4-hydroxy-6-methyl-1,3,3a,7-tetraazaindene was added to the emulsion, and then sodium thiosulfate and chloroauric acid were further added and thus the emulsion was optimally sulfur-gold sensitized at 70° C. for 30 minutes. The resulting emulsion was taken as Emulsion 7.

Method for Preparing Emulsion 8

To an aqueous gelatin solution under stirring (prepared by dissolving 20 g of gelatin, 2 g of sodium chloride, and 0.02 g of a compound

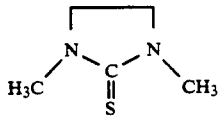

in 800 ml of water and then being maintained at 75° C. by heating), 600 ml of an aqueous solution containing 0.59 mol of silver nitrate and 600 ml of an aqueous solution containing 0.53 mol of potassium bromide and 0.07 mol of sodium chloride were added at the same time at an equal flowing rate over 60 minutes. At the same time the two solutions began to be added, a dye solution prepared by dissolving 0.2 g of Dye (D) in 100 ml of methanol began to be added at a constant flowing rate over 50 minutes. The resulting particles were monodispersed cubic silver chlorobromide particles having a particle size of 0.5 μm. After washing with water and desalting, 25 g of gelatin and 150 ml of water were added to adjust its pH value and pAg to 6 5 and 7.8, respectively. Subsequently, the emulsion was optimally chemically sensitized with triethylthiourea and a decomposition product of nucleic acid. The yield of the resulting emulsion was 700 g. The emulsion was taken as Emulsion 8.

Dye (D)

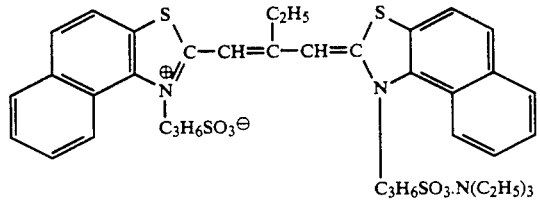

Method for Preparing Emulsion 9

To an aqueous gelatin solution under stirring (prepared by dissolving 20 g of gelatin and 0.5 g of a compound $HO(CH_2)_2S(CH_2)_2S(CH_2)_2OH$ in 1,000 ml of water and then being maintained at 50° C. by heating), 600 ml of an aqueous solution containing 0.72 mol of potassium bromide and 600 ml of an aqueous solution containing 0.59 mol of silver nitrate were added over 45 minutes with the pAg maintained at 9.2. (The whole of aqueous silver nitrate solution was added.)

The resulting particles were monodispersed octahedral particles having a particle size of 0.45 μm. After washing with water and desalting, 25 g of gelatin and 150 ml of water were added to adjust its pH value and pAg to 6.9 and 8.5, respectively. The yield of the resulting emulsion was 700 g.

The emulsion was optimally sulfur sensitized with sodium thiosulfate at 60° C. for 60 minutes. Before the chemical ripening was finished, 0.1 g of a compound

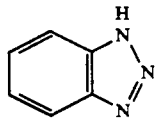

was added to the emulsion. The resulting emulsion was taken as Emulsion 9.

Light-Sensitive Element 3 having the same multilayer constitution as in Example 1 was produced by using Emulsions 7 to 9 in such a manner as shown in the following Table 3 and further Light-Sensitive Element 4 having the same multilayer constitution as in Light-Sensitive Element 3 was produced except that, to each of the first layer, third layer, and fifth layer, an acetylene compound

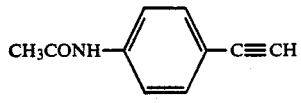

(Compound (a)) was added in an amount of 0.02 g per 1 g of silver of the emulsion.

TABLE 3

| | Light-Sensitive Element 3 | Light-Sensitive Element 4 |
|---|---|---|
| First Layer (infrared-sensitive emulsion layer) | Emulsion 9 | Emulsion 9 + Compound (a) 0.02 g/g Ag |
| Third Layer (red-sensitive emulsion layer) | Emulsion 8 | Emulsion 8 + Compound (a) 0.02 g/g Ag |
| Fifth Layer (green-sensitive emulsion layer) | Emulsion 7 | Emulsion 7 + Compound (1) 0.02 g/g Ag |

The resulting Light-Sensitive Elements 3 and 4 were treated and measured in the same manner as in Example 1. The results obtained are shown in Table 4.

TABLE 4

| | | Relative Sensitivity Treatment Temperature | | Fog Density Treatment Temperature | |
|---|---|---|---|---|---|
| | | 87° C. | 97° C. | 87° C. | 97° C. |
| Light-Sensitive Element 3 (Comparison) | Yellow | 100* | 88 | 0.16 | 0.35 |
| | Magenta | 100* | 90 | 0.14 | 0.30 |
| | Cyan | 100* | 90 | 0.13 | 0.25 |
| Light-Sensitive Element 4 (Invention) | Yellow | 100 | 98 | 0.14 | 0.20 |
| | Magenta | 100 | 100 | 0.12 | 0.17 |
| | Cyan | 100 | 98 | 0.13 | 0.17 |

*The relative sensitivity of Light-Sensitive Element 3 treated at 87° C. was taken as 100.
The relative sensitivity was investigated at a fog of +0.3.

From Table 4, it was found that the effects of the present invention were obtained by addition of the acetylene compound of the present invention to the emulsion just before the emulsion was coated.

EXAMPLE 3

Method for Preparing Emulsions 10 and 11

To an aqueous gelatin solution under stirring (prepared by dissolving 30 g of gelatin, 3 g of potassium bromide, and 1.5 g of a compound $HO(CH_2)_2S(CH_2)_2S(CH_2)_2OH$ in 600 ml of water and then being maintained at 75° C.), Solutions I and II as set forth below were added at the same time over 20 minutes and thus an emulsion having AgBrI core particles (iodide content: 15 mol %) having a particle size of 0.45 μm were obtained. After that, further, Solutions III and IV as set forth below were added at the same time to the above-mentioned emulsion over 30 minutes with the pAg maintained at 7.5. (The whole of Solution III was added.) The resulting particles were monodispersed cubic AgBrI particles having an average particle size of 0.85 μm, and having a halogen distribution where the iodide content of the core part is higher than that of the shell part. After washing with water and desalting, 20 g of gelatin and 150 ml of water were added to adjust its pH value and pAg to 6.5 and 8.3, respectively. The yield of the resulting emulsion was 700 g.

The formulations of Solutions I to IV are shown in Table 5.

TABLE 5

| Ingredient | Solution I | II | III | IV |
|---|---|---|---|---|
| $AgNO_3$ (g) | 20 | 0 | 80 | 0 |
| KBr (g) | 0 | 12 | 0 | 60 |
| KI (g) | 0 | 3 | 0 | 5.6 |
| $H_2O$ (ml) | 320 | 220 | 480 | 350 |

The resulting emulsion was equally divided into two portions each weighing 350 g.

One portion was optimally sulfur-gold sensitized with sodium thiosulfate and chloroauric acid at 65° C. for 60 minutes. After completion of chemical ripening of the emulsion, 0.15 g of 4-hydroxy-6-methyl-1,3,3a,7-tetraazaindene was added. The resulting emulsion was taken as Emulsion 10.

To the other portion, 0.01 g of a compound

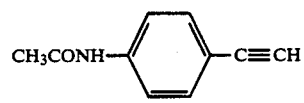

dissolved in methanol was added, and after that, the emulsion was optimally sulfur-gold sensitized with sodium thiosulfate and chloroauric acid at 65° C. for 60 minutes. After completion of chemical ripening of the emulsion, 0.15 g of 4-hydroxy-6-methyl-1,3,3a,7-tetraazaindene was added. The resulting emulsion was taken as Emulsion 11.

Method for Preparing Emulsion 12

To an aqueous gelatin solution under stirring (prepared by dissolving 20 g of gelatin, 1.2 g of potassium bromide, and 0.45 g of a compound $HO(CH_2)_2S(CH_2)_2S(CH_2)_2OH$ in 600 ml of water and then being maintained at 50° C.), 600 ml of an aqueous solution containing 0.59 mol of silver nitrate and 800 ml of an aqueous solution containing 0.75 mol of potassium bromide and 0.038 mol of potassium iodide were added over 50 minutes with the pAg controlled to 8.2. (The whole of the aqueous silver nitrate solution was added.) Thus, an emulsion of monodispersed cubic silver iodidobromide grains (iodide content: 4.8 mol %) having a particle size of 0.4 μm was obtained. In this process, at the same time the halogen solution and the silver nitrate solution began to be added, a dye solution prepared by dissolving 0.12 g of Dye (E) and 0.03 g of the above-mentioned Dye (A) in 100 ml of methanol began to be added over 40 minutes. After washing with water and desalting, 25 g of gelatin and 150 ml of water were added to adjust its pH value and pAg to 6.5 and 8.3, respectively. The yield of the resulting emulsion was 700 g.

Dye (E)

-continued

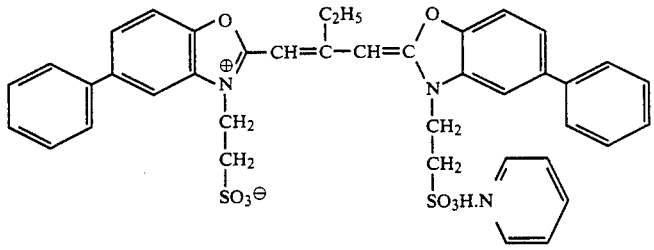

0.1 g of 4-hydroxy-6-methyl-1,3,3a,7-tetraazaindene was added to the resulting emulsion, and then sodium thiosulfate and chloroauric acid were further added and it was optimally sulfur-gold sensitized at 60° C. for 60 minutes. The emulsion was taken as Emulsion 12.

Method for Preparing Emulsion 13

To an aqueous gelatin solution under stirring (prepared by dissolving 20 g of gelatin, 1.2 g of potassium bromide, and 0.4 g of a compound $HO(CH_2)_2S(CH_2)_2S(CH_2)_2OH$ in 600 ml of water and being maintained at 50° C.), 600 ml of an aqueous solution containing 0.59 mol of silver nitrate and 800 ml of an aqueous solution containing 0.80 mol of potassium bromide were added over 50 minutes with the pAg adjusted to 8.9. (The whole of the silver nitrate solution was added.) Thus, an emulsion of monodispersed, potato-like shaped silver bromide particles having an average particle size of 0.4 μm which had face (100) and face (111) mixed was obtained. In this process, at the same time the halogen solution and the silver nitrate solution began to be added, a dye solution prepared by dissolving 0.15 g of Dye (F) and 0.05 g of the above-mentioned Dye (B) in 100 ml of methanol began to be added over 40 minutes. After washing with water and desalting, 25 g of gelatin and 150 ml of water were added to adjust its pH value and pAg to 6.5 and 8.5, respectively. The yield of the resulting emulsion was 700 g.

Dye (F)

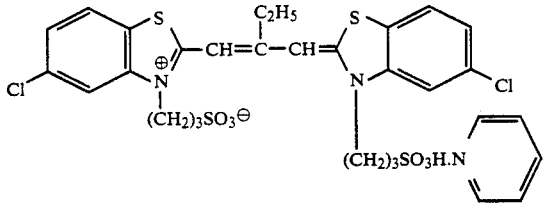

0.1 g of 4-hydroxy-6-methyl-1,3,3a,7-tetraazaindene was added to the resulting emulsion, and then sodium thiosulfate and chloroauric acid were further added and it was optimally sulfur-gold sensitized at 60° C. for 60 minutes. The resulting emulsion was taken as Emulsion 13.

Light-Sensitive Elements 5 and 6 having the construction shown below were produced by using the above-mentioned Emulsions 10, 11, 12 and 13 according to Table 5.

Seventh Layer: Protective Layer
gelatin (350 mg/m$^2$), silica*6 (100 mg/m$^2$)
Sixth Layer: Protective Layer
gelatin (500 mg/m$^2$), hardener*2 (10 mg/m$^2$)
Fifth Layer: Blue-Sensitive Emulsion Layer
Emulsion 10 or 11 (400 mg/m$^2$ as silver), Organic Silver Salt (1) (50 mg/m$^2$ as silver), Organic Silver Salt (2) (50 mg/m$^2$ as silver), hardener*2 (16 mg/m$^2$), Yellow Dye Providing Substance (A) (400 mg/m$^2$), gelatin (1,000 mg/m$^2$), high boiling point solvent*3 (200 mg/m$^2$), surface active agent*4 (100 mg/m$^2$)
Fourth Layer: Intermediate Layer
gelatin (700 mg/m$^2$), hardener*2 (18 mg/m$^2$)
Third Layer: Green-Sensitive Emulsion Layer
Emulsion 12 (300 mg/m$^2$ as silver), Organic Silver Salt (1) (50 mg/m$^2$ as silver), Organic Silver Salt (2) (50 mg/m$^2$ as silver), hardener*2 (18 mg/m$^2$), Magenta Dye Providing Substance (B) (400 mg/m$^2$), gelatin (1,000 mg/m$^2$), high boiling point solvent*5 (200 mg/m$^2$), surface active agent*4 (100 mg/m$^2$)
Second Layer: Intermediate Layer
gelatin (800 mg/m$^2$), hardener*2 (16 mg/m$^2$)
First Layer: Red-Sensitive Emulsion Layer
Emulsion 13 (300 mg/m$^2$ as silver), Organic Silver Salt (1) (50 mg/m$^2$ as silver), Organic Silver Salt (2) (50 mg/m$^2$ as silver), hardener82 (16 mg/m$^2$), Cyan Dye Providing Substance (C) (300 mg/m$^2$), gelatin (1,000 mg/m$^2$), high boiling point solvent83 (150 mg/m$^2$), surface active agent*4 (100 mg/m$^2$)

Support

*2 to *6 have the same meanings as in Example 1.

TABLE 5

| | Light-Sensitive Element 5 | Light-Sensitive Element 6 |
|---|---|---|
| First Layer (red-sensitive emulsion layer) | Emulsion 13 | Emulsion 13 |
| Third Layer (green-sensitive emulsion layer) | Emulsion 12 | Emulsion 12 |
| Fifth Layer (blue-sensitive emulsion layer) | Emulsion 10 | Emulsion 11 |

The above-mentioned Light-Sensitive Elements 5 and 6 each were exposed to light for 1/10 second with a tungsten lamp through a separation filter for B, G and R each having a continuously changing density. After that, Light-Sensitive Elements were treated and measured using the dye fixing element as in Example 1 at 87° C. and at 97° C. by the same manner as in Example 1.

The results obtained are shown in Table 6.

TABLE 6

| | | Relative Sensitivity Treatment Temperature | | Fog Density Treatment Temperature | |
|---|---|---|---|---|---|
| | | 87° C. | 97° C. | 87° C. | 97° C. |
| Light-Sensitive | Yellow | 100* | 95 | 0.17 | 0.35 |
| Element 5 | Magenta | 100* | 95 | 0.15 | 0.25 |
| (Comparison) | Cyan | 100* | 97 | 0.13 | 0.20 |
| Light-Sensitive | Yellow | 105 | 103 | 0.15 | 0.22 |
| Element 6 | Magenta | 100 | 95 | 0.15 | 0.25 |
| (Invention) | Cyan | 100 | 97 | 0.13 | 0.20 |

*The relative sensitivity of Light-Sensitive Element 5 treated at 87° C. was taken as 100.
The relative sensitivity was investigated at a fog of +0.3.

From Table 6, it is found that Light-Sensitive Element 6 using an emulsion chemically ripened by using the acetylene compound of the present invention has a small increase in fog density, in particular, when the light-sensitive element is treated at a high temperature.

EXAMPLE 4

Method for Preparing Emulsion 14

By the same process as in the preparation of Emulsion 10 except that the pAg during the shell part was formed was controlled to 8.0, an emulsion of monodispersed tetradecahedral silver halide particles having a halogen distribution where the iodide content of the core part is higher than that of the shell part which had a particle size of 0.85 μm was obtained.

After washing with water and desalting, 20 g of gelatin and 150 ml of water were added to adjust its pH value and pAg to 7.0 and 8.5, respectively. After that, 0.2 g of 4-hydroxy-6-methyl-1,3,3a,7-tetraazaindene was added to the resulting emulsion and further sodium thiosulfate and chloroauric acid were added to the emulsion. Thus, it was optimally sulfur-gold sensitized at 55° C. for 70 minutes. The emulsion was taken as Emulsion 14.

Light-Sensitive Element 7 having the same multilayer constitution as in Example 3 was produced by using Emulsion 14 and Emulsions 12 and 13 used in Example 3 according to Table 7, and further Light-Sensitive Element 8 having the same constitution as Light-Sensitive Element 7 and except that an acetylene compound

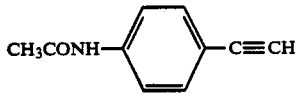

(Compound (a)) was added to each of the first layer, third layer, and fifth layer in an amount of 0.03 g per 1 g of silver of the emulsion was produced.

TABLE 7

| | Light-Sensitive Element 7 | Light-Sensitive Element 8 |
|---|---|---|
| First Layer (red-sensitive emulsion layer) | Emulsion 13 | Emulsion 13 + Compound (a) 0.03 g/g Ag |
| Third Layer (green-sensitive emulsion layer) | Emulsion 12 | Emulsion 12 + Compound (a) 0.03 g/g Ag |
| Fifth Layer (blue-sensitive emulsion layer) | Emulsion 14 | Emulsion 14 + Compound (a) 0.03 g/g Ag |

The same treatment and measurement as in Example 3 was applied to each of Light-Sensitive Elements 7 and 8. The results obtained are shown in Table 8.

TABLE 8

| | | Relative Sensitivity Treatment Temperature | | Fog Density Treatment Temperature | |
|---|---|---|---|---|---|
| | | 87° C. | 97° C. | 87° C. | 97° C. |
| Light-Sensitive | Yellow | 100* | 96 | 0.16 | 0.32 |
| Element 7 | Magenta | 100* | 95 | 0.15 | 0.25 |
| (Comparison) | Cyan | 100* | 97 | 0.13 | 0.20 |
| Light-Sensitive | Yellow | 100 | 98 | 0.15 | 0.23 |
| Element 8 | Magenta | 100 | 99 | 0.13 | 0.18 |
| (Invention) | Cyan | 100 | 100 | 0.10 | 0.13 |

*The relative sensitivity of Light-Sensitive Element 7 treated at 87° C. was taken as 100.
The relative sensitivity was investigated at a fog of +0.3.

From Table 6, it is found that Light-Sensitive Element 8 produced by using emulsions each of which has the acetylene compound of the present invention has a small increase in a fog density and also a small change in the sensitivity when the light-sensitive element is treated at a high temperature.

While the invention has been described in detail and with reference to specific embodiments thereof, it will be apparent to one skilled in the art that various changes and modifications can be made therein without departing from the spirit and scope thereof.

What is claimed is:

1. A method for forming an image comprising heating a heat-developable light-sensitive material comprising a support having thereon at least a light-sensitive silver halide and a binder, simultaneously with or after imagewise exposure thereof in the presence of water, at least one of a base and a base precursor, and an acetylene compound represented by formula (I):

$$R_1—C≡C—R_2 \quad (I)$$

wherein $R_1$ and $R_2$ each represents a hydrogen atom, —COOH, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted alkyoxycarbonyl group, a substituted or unsubstituted aryl group, a substituted or unsubstituted heterocyclic group, or a substituted or unsubstituted carboamoyl group; provided that both $R_1$ and $R_2$ do not represent hydrogen atoms at the same time, wherein said water is supplied to the light-sensitive material or to the light-sensitive material and a dye fixing material, the water being supplied in an amount of from 1/10 of the total weight of the coated layers of the light-sensitive material to the weight of water corresponding to the maximum swelling volume of the coated layers of the light-sensitive material when water is supplied to the light-sensitive material or in an amount of from 1/10 of the total weight of the coated layers of the light sensitive material and the dye fixing material to the maximum swelling volume of the coated layers of the light-sensitive material and dye fixing material when water is supplied to the light-sensitive material and dye fixing material, wherein said water is supplied to the light-sensitive material or said light-sensitive material and said dye fixing material from a source outside said light-sensitive material or said light-sensitive material and said dye fixing material.

2. A method for forming an image as in claim 1, wherein one of $R_1$ and $R_2$ in formula (I) represents a hydrogen atom, and the other represents a group other than a hydrogen atom as mentioned in claim 1 for $R_1$ and $R_2$ in formula (I).

3. A method for forming an image as in claim 2, wherein one of $R_1$ and $R_2$ in formula (I) represents a hydrogen atom, and the other represents a substituted or unsubstituted phenyl group.

4. A method for forming an image as in claim 1, wherein said acetylene compound in a light-sensitive element of said heat-developable light-sensitive material is present in an amount of from $10^{-4}$ to 1 mol based on mol of silver.

5. A method for forming an image as in claim 4, wherein said acetylene compound in a light-sensitive element of said heat-developable light-sensitive material is present in an amount of from $10^{-3}$ to $5\times10^{-1}$ mol based on mol of silver.

6. A method for forming an image as in claim 1, wherein said acetylene compound dissolved in a water-soluble organic solvent and contained in water is present in an amount of from $10^{-4}$ to 1 mol based on liter of water.

7. A method for forming an image as in claim 6, wherein said acetylene compound dissolved in a water-soluble organic solvent and contained in water is present in an amount of from $10^{-3}$ to $10^{-1}$ mol based on liter of water.

8. A method for forming an image as in claim 1, wherein said heat-developable light-sensitive material further comprises an organic silver salt.

9. A method for forming an image as in claim 1, wherein said heat-developable light-sensitive material further comprises a dye providing substance.

10. A method for forming an image as in claim 1, wherein said acetylene compound in a dye fixing element of said heat-developable light-sensitive material is present in an amount of from $10^{-6}$ to $10^{-2}$ mol/m$^2$.

11. A method for forming an image as in claim 10, wherein said acetylene compound in a dye fixing element of said heat-developable light-sensitive material is present in an amount of from $10^{-5}$ to $10^{-3}$ mol/m$^2$.

12. A method for forming an image as in claim 11, wherein said dye providing substance is a compound represented by formula (LI):

$$(\text{Dye}-X)_n-Y \qquad \text{(LI)}$$

wherein Dye represents a dye group, a dye group temporarily shifted to a short wavelength, or a dye precursor; X represents a chemical bond or a linking group; Y represents a group having a property as to cause a difference in the diffusibility of said compound represented by formula (LI) corresponding or countercorresponding to a light-sensitive silver salt having a latent image, or a group having a property as to release Dye corresponding or countercorresponding to a light-sensitive silver salt having a latent image so as to cause a difference in diffusibility between the thus released Dye and said compound represented by formula (LI); and n represents 1 or 2.

13. A method for forming an image as in claim 1, wherein a light-sensitive element and a dye fixing element of said light-sensitive material are provided on different supports.

14. A method for reducing fog of an image formed by heating a heat-developable light sensitive material comprising a support having thereon at least a layer comprising a light-sensitive silver halide and a binder which is supplied with water, simultaneously with or after imagewise exposure thereof in the presence of water, at least one of a base and a base precursor, and an acetylene compound represented formula (I):

$$R_1-C\equiv C-R_2 \qquad \text{(I)}$$

wherein $R_1$ and $R_2$ each represents a hydrogen atom, —COOH, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted alkyoxycarbonyl group, a substituted or unsubstituted aryl group, a substituted or unsubstituted heterocyclic group, or a substituted or unsubstituted carboamoyl group; provided that both $R_1$ and $R_2$ do not represent hydrogen atoms at the same time, wherein water is supplied to the light-sensitive material or to the light-sensitive material and a dye fixing material, the water being supplied in an amount of from 1/10 of the total weight of the coated layers of the light-sensitive material to the weight of water corresponding to the maximum swelling volume of the coated layers of the light-sensitive material when water is supplied to the light-sensitive material or in an amount of from 1/10 of the total weight of the coated layers of the light sensitive material and the dye fixing material to the maximum swelling of the coated layers of the light-sensitive material and the dye fixing material when water is supplied to the light-sensitive material and the dye fixing material, wherein the water is supplied to the light-sensitive material or the light-sensitive material and the dye fixing material from a source outside the light-sensitive material or the light-sensitive material and the dye fixing material, the heat-developable light-sensitive material being heated in the presence of the water to develop the heat-developable light-sensitive material.

* * * * *